US011279125B2

(12) United States Patent
Kodama

(10) Patent No.: US 11,279,125 B2
(45) Date of Patent: Mar. 22, 2022

(54) IMAGE FORMING APPARATUS AND STORAGE MEDIUM STORING PROGRAM

(71) Applicant: BROTHER KOGYO KABUSHIKI KAISHA, Nagoya (JP)

(72) Inventor: Shoko Kodama, Anjo (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/036,087

(22) Filed: Sep. 29, 2020

(65) Prior Publication Data

US 2021/0094278 A1 Apr. 1, 2021

(30) Foreign Application Priority Data

Sep. 30, 2019 (JP) ..... JP2019-179125

(51) Int. Cl.
*B41J 2/045* (2006.01)
*B41J 2/145* (2006.01)
*B41J 11/00* (2006.01)

(52) U.S. Cl.
CPC ..... *B41J 2/04508* (2013.01); *B41J 2/0451* (2013.01); *B41J 2/04586* (2013.01); *B41J 2/145* (2013.01); *B41J 11/008* (2013.01)

(58) Field of Classification Search
CPC .. B41J 2/04508; B41J 2/0451; B41J 2/04586; B41J 2/145; B41J 11/008
See application file for complete search history.

(56) References Cited

U.S. PATENT DOCUMENTS 8,272,707 B2 * 9/2012 Kashimoto ..... B41J 19/145 347/14
2015/0375503 A1 12/2015 Sato et al.
2018/0065359 A1 3/2018 Yamaguchi et al.

FOREIGN PATENT DOCUMENTS

JP 2016-007824 A 1/2016
JP 2018-041221 A 3/2018
WO WO 2008102591 A1 8/2008

* cited by examiner

*Primary Examiner* — Thinh H Nguyen
(74) *Attorney, Agent, or Firm* — Scully, Scott, Murphy & Presser, PC

(57) ABSTRACT

A controller determines an original conveyance distance; determines whether a particular code image is to be recorded on a recording medium; when the particular code image is to be recorded, determines, based on the image data and on identification information of a defective ejection port, whether the first region is to be formed with liquid ejected from the defective ejection port assuming that the medium is conveyed by the original conveyance distance; when the first region is to be formed with liquid ejected from the defective ejection port, determines a shortened conveyance distance such that the defective ejection port is located at a position corresponding to a second region with respect to the conveyance direction; performs shortened conveyance processing of controlling the conveyor to convey the medium in the conveyance direction by the shortened conveyance distance; and controls the carriage and the head to record the image on the medium.

20 Claims, 12 Drawing Sheets

IMAGE FORMING APPARATUS AND STORAGE MEDIUM STORING PROGRAM

CROSS REFERENCE TO RELATED APPLICATIONS

This application claims priority from Japanese Patent Application No. 2019-179125 filed Sep. 30, 2019. The entire content of the priority application is incorporated herein by reference.

TECHNICAL FIELD

This disclosure relates to an image forming apparatus configured to print a code image and a storage medium storing a program.

BACKGROUND

A disclosed technique is that, regarding a serial-type inkjet printer that ejects ink droplets while moving the recording head in the main scanning direction, in a case where there is a defective nozzle, a nozzle that ejects ink droplets of the same color as the defective nozzle is used to eject ink droplets that are supposed to be ejected from the defective nozzle. In this technique, a line along the main scanning direction is formed by scanning a plurality of times, and the dots adjacent to a print dot of the defective nozzle are set as substitute dot candidates, and one of non-print dots of the substitute dot candidates is used as a print dot.

SUMMARY

According to one aspect, this specification discloses an image forming apparatus. The image forming apparatus includes a head, a conveyor, a carriage, a memory, and a controller. The head has a plurality of ejection ports configured to eject liquid. The conveyor is configured to convey a recording medium in a conveyance direction. The head is mounted on the carriage. The carriage is configured to reciprocate in a main scanning direction perpendicular to the conveyance direction. The memory is configured to store identification information of a defective ejection port among the plurality of ejection ports and to store image data for an image to be recorded on a recording medium. The controller is configured to: determine an original conveyance distance based on image data stored in the memory; determine, based on the image data, whether a particular code image is to be recorded on the recording medium, the particular code image being formed with a plurality of printed regions and a plurality of non-printed regions, the particular code image including a first region and a second region, the first region being a region prohibited from being formed with the defective ejection port, the second region being a region other than the first region; in response to determining that the particular code image is to be recorded on the recording medium, determine, based on the image data and on the identification information of the defective ejection port, whether the first region is to be formed with liquid ejected from the defective ejection port assuming that the recording medium is conveyed by the original conveyance distance in conveyance processing; in response to determining that the first region is to be formed with liquid ejected from the defective ejection port, determine a shortened conveyance distance shorter than the original conveyance distance, the shortened conveyance distance being determined such that the defective ejection port is located at a position corresponding to the second region with respect to the conveyance direction; perform shortened conveyance processing of controlling the conveyor to convey the recording medium in the conveyance direction by the shortened conveyance distance; and after performing the shortened conveyance processing, control the carriage to cause the head to move in the main scanning direction and control the head to record the image on the recording medium.

According to another aspect, this specification also discloses an image forming apparatus. The image forming apparatus includes a head, a conveyor, a carriage, a memory, and a controller. The head has a plurality of ejection ports configured to eject liquid. The conveyor is configured to convey a recording medium in a conveyance direction. The head is mounted on the carriage. The carriage is configured to reciprocate in a main scanning direction perpendicular to the conveyance direction. The memory is configured to store identification information of a defective ejection port among the plurality of ejection ports and to store image data for an image to be recorded on a recording medium. The controller is configured to: determine a conveyance distance based on image data stored in the memory; determine, based on the image data, whether a particular code image is to be recorded on the recording medium, the particular code image being formed with a plurality of printed regions and a plurality of non-printed regions, the particular code image including a first region and a second region, the first region being a region prohibited from being formed with the defective ejection port, the second region being a region other than the first region; in response to determining that the particular code image is to be recorded on the recording medium, determine, based on the image data and on the identification information of the defective ejection port, whether the first region is to be formed with liquid ejected from the defective ejection port assuming that the recording medium is conveyed by the original conveyance distance in conveyance processing; in response to determining that the first region is to be formed with liquid ejected from the defective ejection port, change a position of the particular code image in the conveyance direction in the image data stored in the memory, the position of the particular code image in the image data being changed such that the defective ejection port is located at a position corresponding to the second region with respect to the conveyance direction; perform conveyance processing of controlling the conveyor to convey the recording medium in the conveyance direction by the determined conveyance distance; and after performing the conveyance processing, control the carriage to cause the head to move in the main scanning direction and control the head to record the image on the recording medium.

According to still another aspect, this specification also discloses a non-transitory computer-readable storage medium storing a set of program instructions for a computer of an electronic device that controls an image forming apparatus. The set of program instructions, when executed by the computer, causing the electronic device to: determine a conveyance distance of a recording medium based on image data stored in a memory of the image forming apparatus, the image forming apparatus including a head having a plurality of ejection ports configured to eject liquid, a conveyor configured to convey a recording medium in a conveyance direction, a carriage on which the head is mounted and configured to reciprocate in a main scanning direction perpendicular to the conveyance direction, the image forming apparatus being configured to perform conveyance processing of controlling the conveyor to convey a recording medium in the conveyance direction and scanning processing of controlling the carriage to cause the head to move in the main scanning direction and controlling the head to record an image on the recording medium, the memory storing identification information of a defective ejection port among the plurality of ejection ports; determine whether a particular code image is to be recorded on the recording medium, the particular code image being formed with a plurality of printed regions and a plurality of non-printed regions, the particular code image including a first region and a second region, the first region being a region prohibited from being formed with the defective ejection port, the second region being a region other than the first region; in response to determining that the particular code image is to be recorded on the recording medium, determine, based on the image data and on the identification information of the defective ejection port, whether the first region is to be formed with liquid ejected from the defective ejection port assuming that the conveyance processing is performed with the original conveyance distance; and in response to determining that the first region is to be formed with liquid ejected from the defective ejection port, perform either one of: shortening the conveyance distance in at least one of one or a plurality of times of the conveyance processing that is performed before the scanning processing in which the first region is formed, the conveyance distance being shortened such that the defective ejection port is located at a position corresponding to the second region with respect to the conveyance direction when the scanning processing is performed after shortening the conveyance distance; and changing a position of the particular code image in the conveyance direction in the image data such that the defective ejection port is located at a position corresponding to the second region with respect to the conveyance direction when the scanning processing is performed after changing the position of the particular code image in the image data.

BRIEF DESCRIPTION OF THE DRAWINGS

Embodiments in accordance with this disclosure will be described in detail with reference to the following figures wherein:

FIGS. 5A to 5C are explanatory diagrams for illustrating shortening processing in the first embodiment, wherein FIG. 5A shows a conveyance distance determined in determination processing and FIGS. 5B and 5C show a conveyance distance shortened in shortening processing;

FIGS. 7A and 7B are explanatory diagrams for illustrating shortening processing in a second embodiment, wherein FIG. 7A shows a conveyance distance determined in determination processing and FIG. 7B shows a conveyance distance shortened in shortening processing;

DETAILED DESCRIPTION

In a serial type inkjet printer, in a case where a one-dimensional code image formed of a bar (printed region) and a space between two adjacent bars (non-printed region) is printed in a direction in which the longitudinal direction of each bar is the same as the main scanning direction, if the position of the defective nozzle that causes ejection failure (no ink is ejected) and ejection direction displacement in the conveyance direction (the direction perpendicular to the main scanning direction) corresponds to within the width of a bar, ink is not ejected from the defective nozzle or ink ejected from the defective nozzle does not land at a desired position, and a part of the bar becomes blank, or an unnecessary black streak is formed. In such a case, there is a possibility that the data displayed on the code image cannot be read or the data different from the original data may be read.

Further, both one-dimensional and two-dimensional code images includes one or more data areas for displaying the data to be read and one or more functional areas excluding the one or more data areas (areas for displaying information for assisting data reading of a data area, such as a check digit in the case of a one-dimensional code image, and an alignment pattern and a timing pattern in the case of a two-dimensional code image). In this case, if a white streak (white portion) or a black streak occur in cells in the functional area, a reading error is likely to occur.

In a case where the above-described technique is applied to the printing of the code image, as described above, one of the non-print dots adjacent to the print dot of the defective nozzle is used as the print dot, and thus the shape of the bar may not be exactly the same as the case where there is no defective nozzle. Hence, a reading error may occur when reading the code image. Further, since the line along the main scanning direction is formed by scanning a plurality of times, the recording speed may decrease.

In view of the foregoing, an example of an object of this disclosure is to provide an image forming apparatus and a storage medium storing a program capable of recording a code image at high speed even in a case where a recording head has a defective ejection port and also suppressing the occurrence of a reading error.

A printer as an image forming apparatus of embodiments of this disclosure will be described while referring to the accompanying drawings.

First Embodiment

Figure 1:
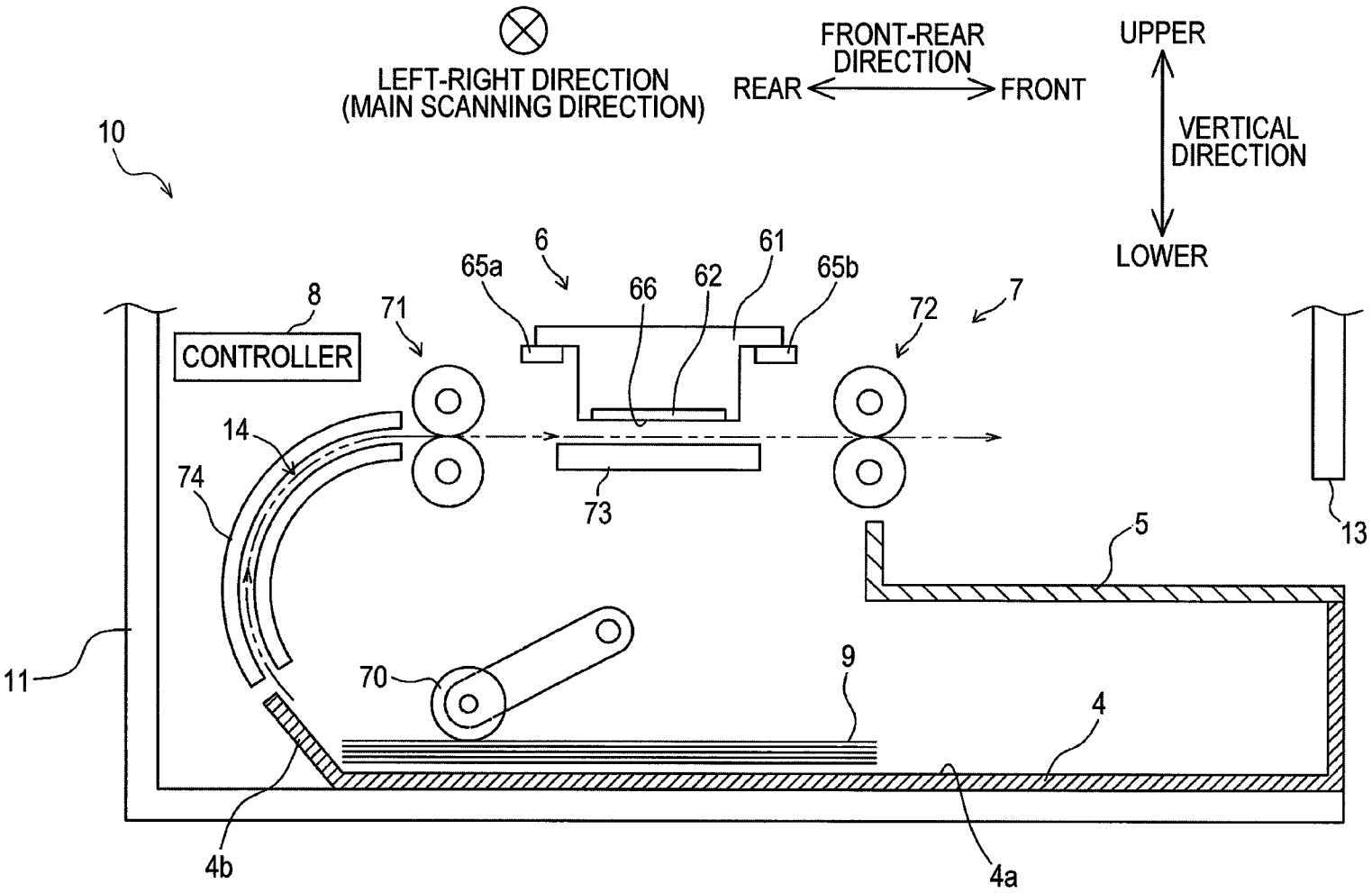
FIG. 1 is a schematic side view showing the internal structure of a printer according to a first embodiment of this disclosure.

First, a printer 10 according to a first embodiment will be described. As shown in FIG. 1, the printer 10 includes a paper feed tray 4, a paper discharge tray 5, a scanning mechanism 6, a conveyance mechanism 7, and a controller 8. In the following description, a vertical direction is defined based on the state where the printer 10 is installed in a usable state (the state of FIG. 1). A front-rear direction is defined assuming that the side where an opening 13 of a housing 11 is provided is the near side (front side). Further, a left-right direction is defined when viewed from the front side of the printer 10. The paper feed tray 4, the scanning mechanism 6, the conveyance mechanism 7, and the controller 8 are housed in the housing 11 of the printer 10. The paper feed tray 4 is arranged below the scanning mechanism 6 in the housing 11.

The paper feed tray 4 is configured to support and accommodate a plurality of sheets of paper 9 in a stacked state. The paper feed tray 4 is configured to be inserted into and removed from the housing 11 in the front-rear direction. The paper feed tray 4 has a support surface 4*a* that supports the paper 9. An inclined plate 4*b* is provided at the rear end of the paper feed tray 4.

The paper discharge tray 5 accommodates the paper 9 on which an image is recorded by a recording head 62 of the scanning mechanism 6 described later. The paper discharge tray 5 is arranged above the front side of the paper feed tray 4, and is configured to move as the paper feed tray 4 is inserted into and removed from the housing 11.

Figure 2:
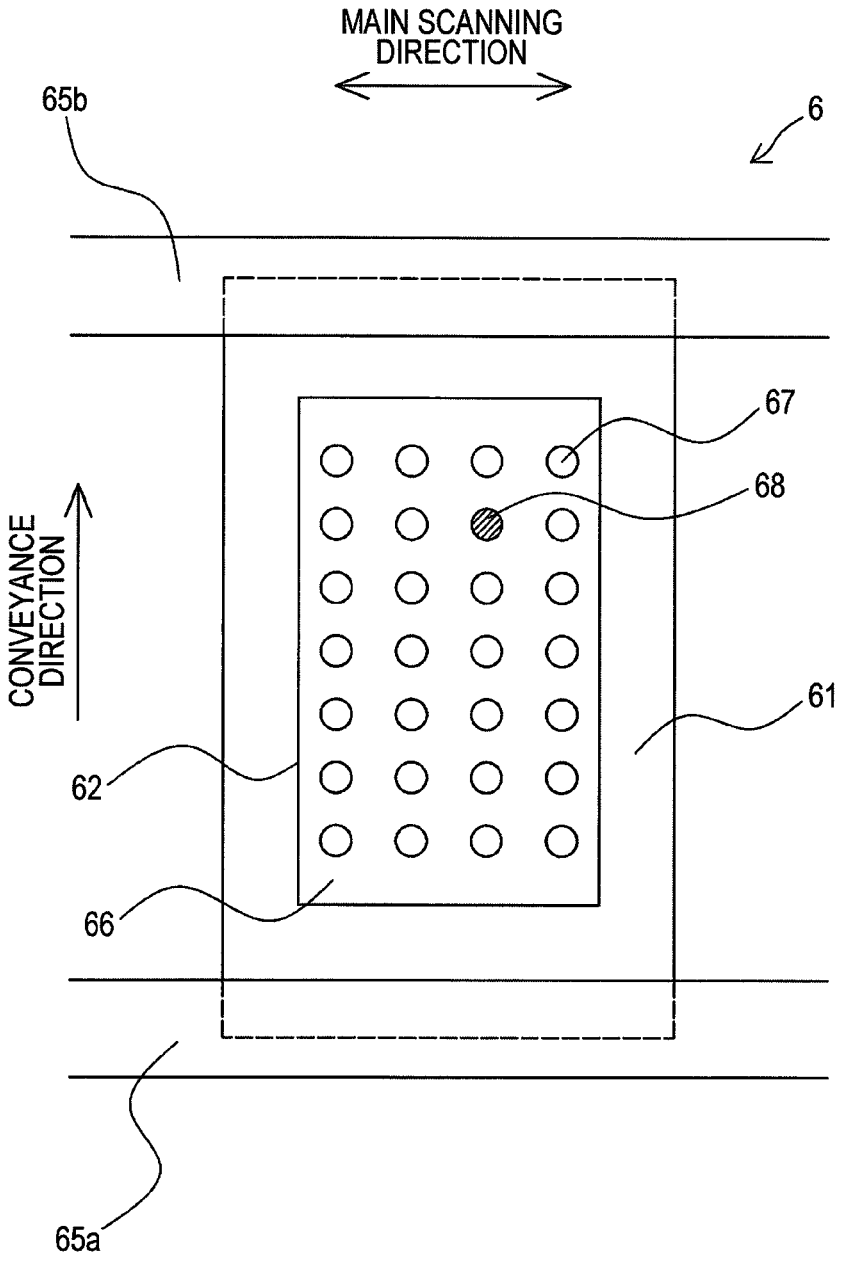
FIG. 2 is a bottom view of a recording head having a defective nozzle.

The scanning mechanism 6 includes a carriage 61 and the recording head 62. As shown in FIGS. 1 and 2, the carriage 61 is supported by two guide rails 65*a* and 65*b*. The two guide rails 65*a* and 65*b* are arranged to be separated from each other in the front-rear direction, and each of the guide rails 65*a* and 65*b* extends in the left-right direction. The carriage 61 is arranged to straddle the two guide rails 65*a* and 65*b*. The carriage 61 is driven by a carriage motor 31 (see FIG. 3) so as to reciprocate along the two guide rails 65*a* and 65*b* in the left-right direction which is the main scanning direction.

The recording head 62 is mounted on the carriage 61 and reciprocates in the main scanning direction together with the carriage 61. As shown in FIG. 2, a plurality of nozzles (ejection ports) 67 for ejecting ink are provided on a nozzle surface 66 on the lower surface of the recording head 62 so as to be arranged along the conveyance direction (the front-rear direction) perpendicular to the main scanning direction. The nozzles 67 are arranged on the nozzle surface 66 in four rows in the main scanning direction, and ejects ink supplied from four ink cartridges (not shown) that store ink of four colors (black, cyan, magenta, and yellow) from the nozzles 67 in the respective rows, thereby recording an image on paper 9. That is, the printer 10 in this embodiment is an inkjet serial printer capable of recording a color image. Among the nozzles 67, a nozzle that cannot eject ink or causes a deviation in the ejection direction and so on is defined as a defective nozzle 68 (the hatched portion in FIG. 2).

The conveyance mechanism 7 conveys the paper 9 inside the printer 10, and includes a paper feed roller 70, a pair of conveyance rollers 71, a pair of discharge rollers 72, a platen 73, and a guide member 74. The paper feed roller 70 is disposed above the paper feed tray 4, and is rotated by being applied with a driving force from a paper feed motor 32 (see FIG. 3), thereby sending the paper 9 accommodated in the paper feed tray 4 rearward. The pair of conveyance rollers 71 and the pair of discharge rollers 72 are arranged to sandwich the scanning mechanism 6 in the front-rear direction. The pair of conveyance rollers 71 is arranged at the rear of the scanning mechanism 6, and the pair of discharge rollers 72 is arranged at the front of the scanning mechanism 6. The pair of conveyance rollers 71 sends the paper 9 to a region facing the nozzle surface 66 of the recording head 62. The pair of discharge rollers 72 receives the paper 9 sent by the pair of conveyance rollers 71, and discharges the paper 9 to the paper discharge tray 5. The pair of conveyance rollers 71 and the pair of discharge rollers 72 are driven to rotate by a conveyance motor 33 (see FIG. 3).

The platen 73 is arranged below the scanning mechanism 6 so as to face the nozzle surface 66 of the scanning mechanism 6. The guide member 74 defines a conveyance path 14 for sending the paper 9 sent out from the paper feed tray 4 by the paper feed roller 70 to a region facing the nozzle surface 66 of the recording head 62. The guide member 74 extends from a position near the rear end of the paper feed tray 4 to a position near the pair of conveyance rollers 71.

The paper 9 fed rearward from the paper feed tray 4 by the paper feed roller 70 is directed obliquely upward by the inclined plate 4*b* provided at the rear end of the paper feed tray 4, passes through the conveyance path 14 defined by the guide member 74, and reaches a position where the paper 9 is nipped by the pair of conveyance rollers 71. The paper 9 nipped by the pair of conveyance rollers 71 is conveyed to a region facing the nozzle surface 66 of the recording head 62 by the rotation of the pair of conveyance rollers 71. In a state where the paper 9 conveyed by the pair of conveyance rollers 71 is supported by the platen 73, ink is ejected from nozzles 67 provided on the nozzle surface 66 of the recording head 62 that moves in the scanning direction so that an image is recorded on the paper 9. The paper 9 on which the image is recorded is conveyed forward by the pair of discharge rollers 72 and is discharged onto the paper discharge tray 5.

Figure 3:
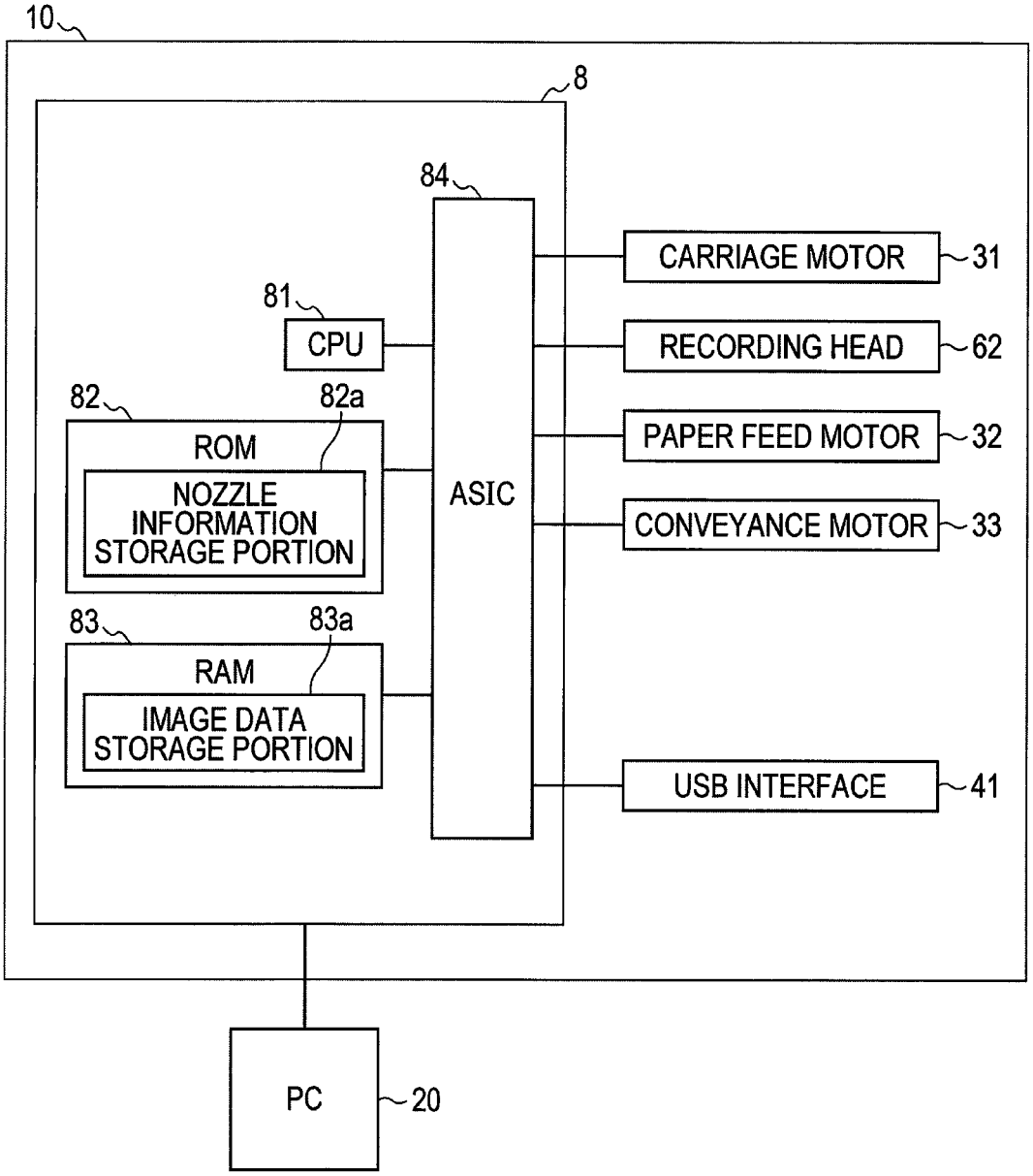
FIG. 3 is a block diagram schematically showing the electrical configuration of the printer shown in FIG. 1 and a PC connected to the printer.

The controller 8 controls the entire printer 10, and as shown in FIG. 3, the carriage motor 31, the recording head 62, the paper feed motor 32, the conveyance motor 33, and so on are electrically connected. Further, a USB interface 41 is electrically connected to the controller 8. The USB interface 41 is a USB standard interface and can be connected to a USB memory as a removable memory. In addition, a PC (Personal Computer) 20 that is an external device is connected to the controller 8 of the printer 10. The printer 10 and the PC 20 may be connected through a LAN (Local Area Network), or may be connected not through the LAN. Further, the data transmission/reception between the printer 10 and the PC 20 may be performed by wireless communication or wired communication. It is also possible to wirelessly connect a portable terminal such as a smartphone to the printer 10 through a LAN or directly.

The controller 8 includes a CPU (Central Processing Unit) 81, a ROM (Read Only Memory) 82, a RAM (Random Access Memory) 83, an ASIC (Applicant Specific Integrated Circuit) 84, and so on. The ROM 82 stores programs executed by the CPU 81 and the ASIC 84, various fixed data, and so on. At least part of the ROM 82 is an electrically erasable and rewritable EEPROM (Electrically Erasable Programmable Read-Only Memory). The EEPROM includes a nozzle information storage portion 82*a* that stores the identification information of the defective nozzle 68 among the plurality of nozzles 67. The RAM 83 includes an image data storage portion 83*a* that stores image data relating to the image recorded on the paper 9. The identification information of the defective nozzle 68 stored in the nozzle information storage portion 82*a* is updated at appropriate timing. The identification information of the defective nozzle 68 may be obtained by the following method. For example, it may be determined whether the target nozzle fails to eject ink based on a signal outputted from a determination circuit, by driving the recording head such that ink is ejected from a target nozzle toward a detection electrode in a state where the carriage is located at the maintenance position. Further, by determining whether color mixing has occurred based on a test pattern that is recorded by ejecting ink from the recording head, a nozzle that causes a deviation in the ejection direction may be detected.

The PC 20 has a CPU, a ROM, a RAM, and an HDD (Hard Disk Drive), which are not shown. An OS (Operation System) and a printer driver are installed in the HDD. The CPU controls the operation of the printer 10 by executing the printer driver. The printer driver may be also installed in the ROM of the mobile terminal.

When image data is inputted from the USB memory connected to the USB interface 41 or the PC 20, the controller 8 causes the CPU 81 and the ASIC 84 to execute scanning processing and conveyance processing, based on the program stored in the ROM 82 and on the defective nozzle information and image data temporarily stored in the EEPROM and the RAM 83. As a result, the image relating to the image data is printed on the paper 9. In the scanning processing, the controller 8 controls the driving of the carriage motor 31 and the recording head 62 such that the recording head 62 is moved in the main scanning direction by the scanning mechanism 6 and that ink is ejected from the nozzles 67, thereby recording an image on the paper 9. In the conveyance processing, the controller 8 controls the driving of the conveyance motor 33 such that the paper 9 is conveyed in the conveyance direction by the conveyance mechanism 7. In the printer 10 according to the present embodiment, the image relating to the inputted image data is recorded on the paper 9 by repeatedly performing the scanning processing and the conveyance processing.

Figure 4:
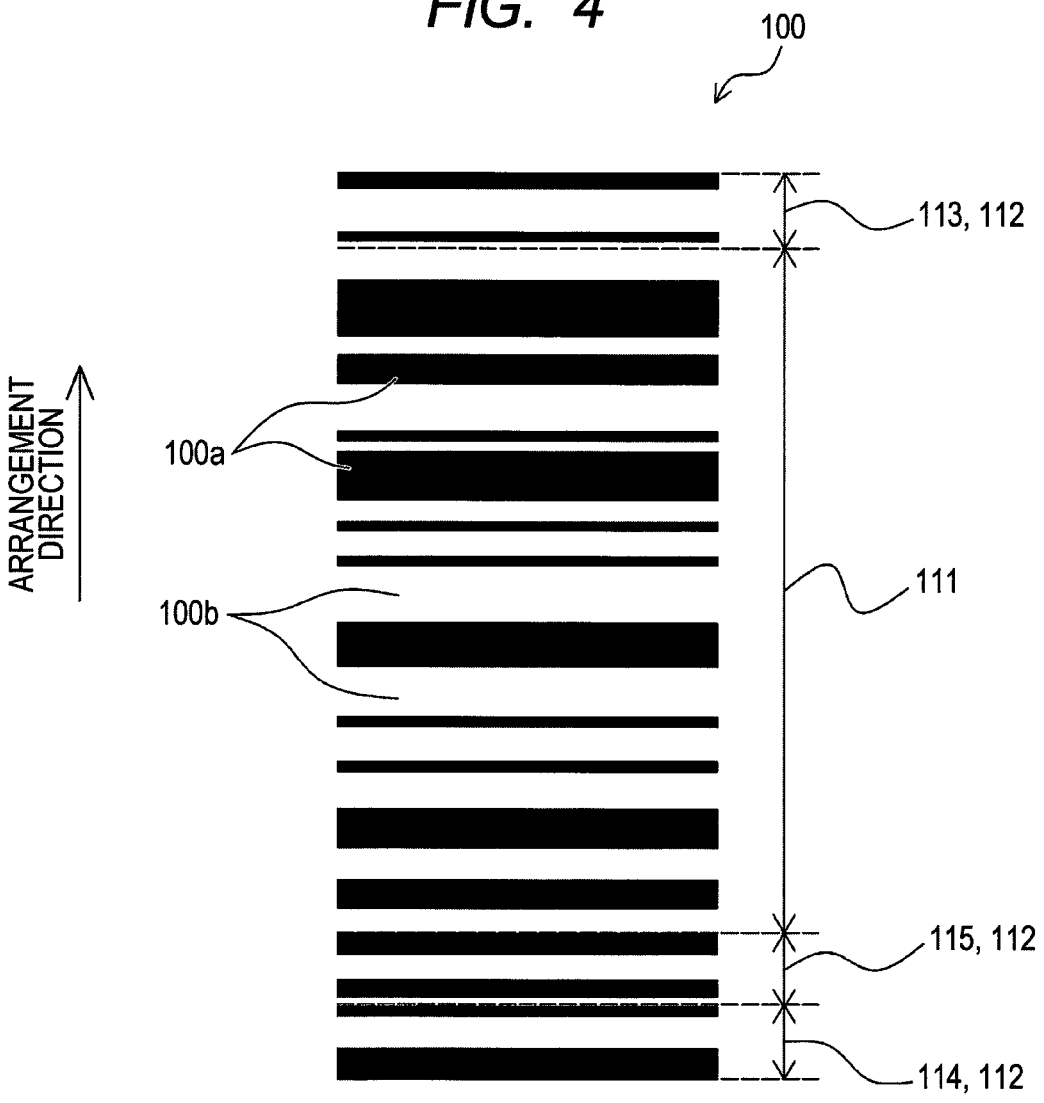
FIG. 4 is an explanatory diagram for illustrating a one-dimensional code image.

Next, image data which is the target of the present embodiment will be described. As shown in FIG. 4, the present embodiment is directed to image data relating to an image 50 including a one-dimensional code image 100 including a plurality of printed regions 100*a* and a plurality of non-printed regions 100*b*. More specifically, each of the printed regions 100*a* has a bar shape. The one-dimensional code image 100 has a patten in which the plurality of printed regions 100*a* and the plurality of non-printed regions 100*b* are formed alternately in one direction (the direction perpendicular to the elongated direction of the printed region 100*a*). The one direction in which the plurality of printed regions 100*a* and the plurality of non-printed region 100*b* are formed alternately is the arrangement direction of the printed regions 100*a* in the one-dimensional code image 100 (the vertical direction in FIG. 4), and will be simply referred to as "arrangement direction" in the following description. The present embodiment is directed to the one-dimensional code image 100 that is formed on paper 9 such that the conveyance direction of the paper 9 is the same as the arrangement direction.

Each printed region 100*a* and each non-printed region 100*b* in the one-dimensional code image 100 have one of a plurality of widths (the size in the arrangement direction) specified according to a standard. The width of each printed region 100*a* and each non-printed region 100*b* in the one-dimensional code image 100 differs depending on information to be displayed by the one-dimensional code image 100. In the present embodiment, the one-dimensional code image 100 is a bar code. As shown in FIG. 4, the one-dimensional code image 100 is divided into a data area 111 and a functional area 112. The data area 111 is an area in which data to be read is displayed. The functional area 112 is the area other than the data area 111, and includes a start code 113 located at one end in the arrangement direction, a stop code 114 located on the opposite side of the start code with respect to the arrangement direction, and a check digit 115 located between the start code 113 and the stop code 114. The start code 113 indicates the beginning of the information to be displayed by the one-dimensional code image 100. The stop code 114 indicates the end of the information to be displayed by the one-dimensional code image 100. The check digit 115 contains information for checking the presence of an error in reading the one-dimensional code image 100.

Next, the operation of the printer 10 according to the first embodiment when recording the image 50 on paper 9 will be described with reference to the flowchart of FIG. 6. First, based on an operation interface (not shown) of the printer 10 or an operation on the PC 20 by the user, a print command relating to image data is supplied to the printer 10. In response to this, the image data is supplied from the USB memory or the PC 20 to the printer 10 and is temporarily stored in the image data storage portion 83*a* of the RAM 83.

Figure 5A:
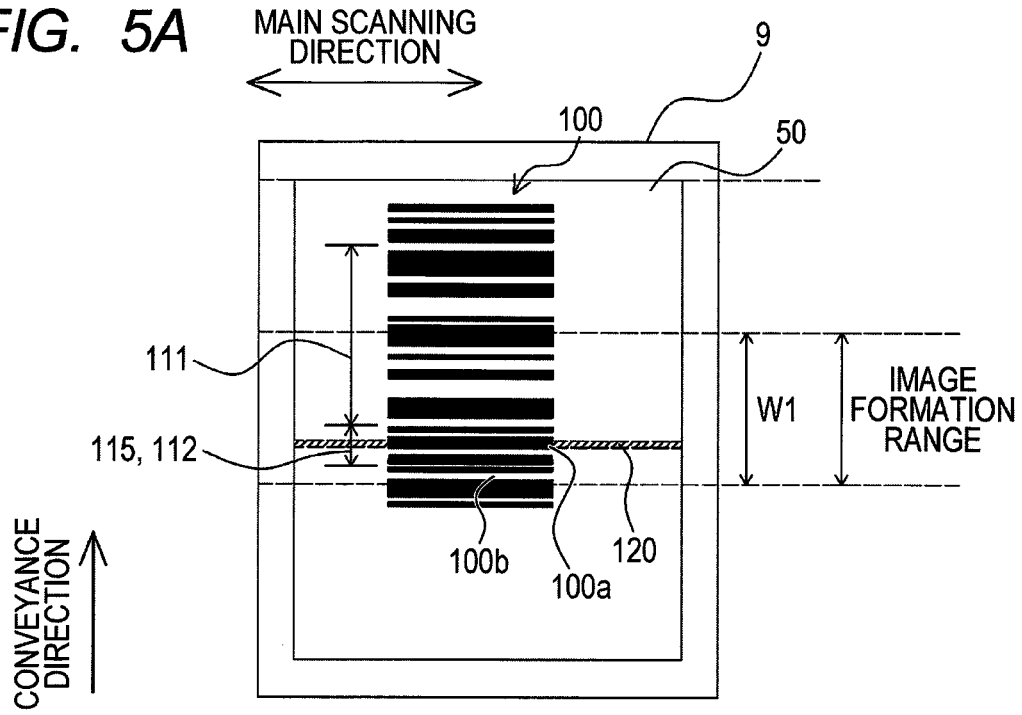

The controller 8 performs determination processing (S1) of determining a conveyance distance W1 by which the paper 9 is to be conveyed (see FIG. 5A) in conveyance processing performed later based on the image data stored in the image data storage portion 83*a*. The conveyance distance W1 is an arbitrary distance that is shorter than or equal to the length (unit conveyance length) of the range (hereinafter referred to as "image formation range") in the conveyance direction in which an image can be formed by ejecting ink from the nozzles 67 while moving the recording head 62 in the main scanning direction by using the scanning mechanism 6. In the example of FIG. 5A, the conveyance distance W1 has the same length (width) as the image formation range. Next, the controller 8 performs first determination processing of determining whether the image 50 including the one-dimensional code image 100 is to be recorded on the paper 9 such that the arrangement direction of the one-dimensional code image 100 is the same as the conveyance direction (S2). The arrangement direction is a direction in which the printed regions 100*a* in the one-dimensional code image 100 are arranged. That is, the arrangement direction is a particular direction in which the plurality of printed regions 100*a* and the plurality of non-printed regions 100*b* in the one-dimensional code image 100 are formed alternately.

In response to determining that the image 50 is to be recorded on the paper 9 such that the arrangement direction of the one-dimensional code image 100 is not the same as the conveyance direction (S2: NO), the controller 8 performs normal conveyance processing (S3) of conveying the paper 9 in the conveyance direction by the conveyance distance W1 determined in the determination processing (S1). In response to determining that the image 50 is to be recorded on the paper 9 such that the arrangement direction of the one-dimensional code image 100 is the same as the conveyance direction (S2: YES), the controller 8 performs second determination processing (S4) of determining whether, in a case where the conveyance processing is performed by the conveyance distance W1 determined in the determination processing (S1), one of the printed regions 100*a* in the functional area 112 is formed with ink ejected from the defective nozzle 68. In the second determination processing (S4), the controller 8 performs determination based on the identification information on the defective nozzle 68 stored in the nozzle information storage portion 82*a* and on the image data stored in the image data storage portion 83*a*.

In response to determining that, in a case where the conveyance processing is performed by the conveyance distance W1, none of the printed regions 100*a* in the functional area 112 is formed with ink ejected from the defective nozzle 68 (S4: NO), the controller 8 performs the normal conveyance processing (S3). In response to determining that, in a case where the conveyance processing is performed by the conveyance distance W1, one of the printed regions 100*a* in the functional area 112 is formed with ink ejected from the defective nozzle 68 (S4: YES), the controller 8 performs shortening processing (S5) of determining that conveyance processing before a scanning processing described later is to be performed with a distance W2 (see FIGS. 5B and 5C) which is shorter than the conveyance distance W1 determined in determination processing (S1).

Figure 5B:
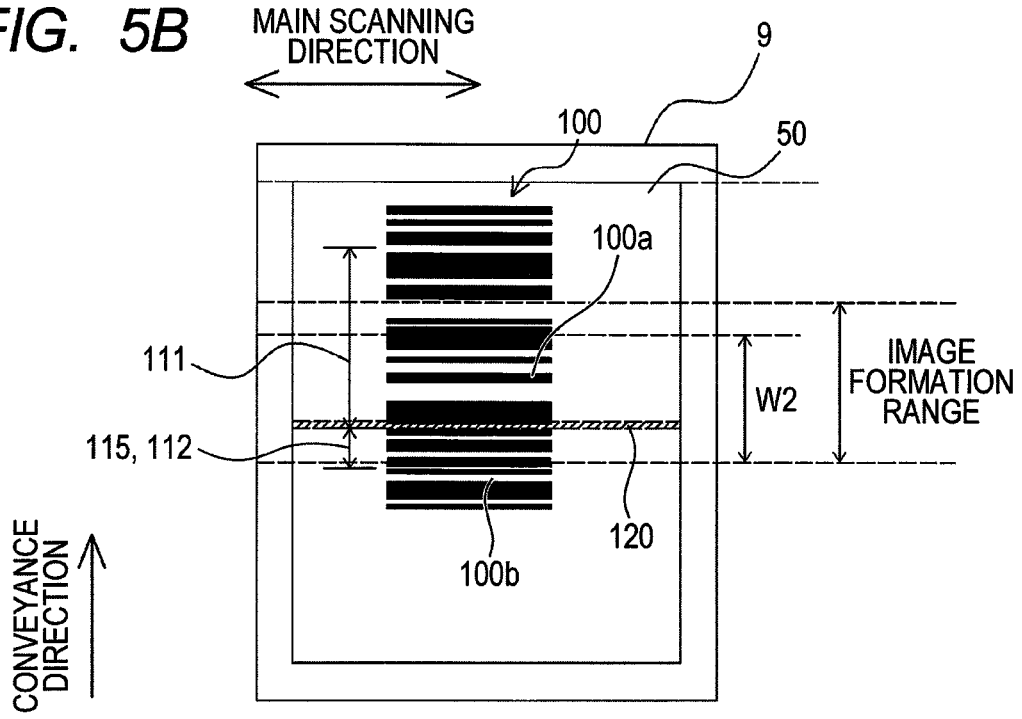

The shortening processing (S5) will be described below in detail. Here, referring to FIGS. 5A to 5C, the conveyance processing to be performed after an image is recorded in an image formation range by one scanning processing will be considered. As shown in FIG. 5A, if the paper 9 is conveyed in the conveyance direction by a length corresponding to the conveyance distance W1 determined in the determination processing (S1), a part of the printed region 100*a* in the check digit 115 in the functional area 112 is formed with ink ejected from the defective nozzle 68 (the obliquely hatched portion in FIG. 5A; hereinafter referred to as "defective nozzle passing region 120"). In this case, the controller 8 shortens the conveyance distance to the distance W2 shorter than the conveyance distance W1 such that, as shown in FIG. 5B, the defective nozzle passing region 120 is located inside the data area 111 (the defective nozzle passing region 120 may be located either in the printed region 100*a* or in the non-printed region 100*b*). A reading error is more likely to occur when a white streak or a black streak appears in a bar in the functional area 112 than in the data area 111. Hence, by moving the defective nozzle passing region 120 to the data area 111 as described above, a risk of a reading error can be reduced.

That is, the controller 8 performs the shortening processing (S5) such that the defective nozzle 68 originally supposed to be used for ejecting ink for forming the printed region 100*a* in the functional area 112 is located at a position corresponding to the data area 111 with respect to the conveyance direction, at the time of performing the scanning processing after the shortening processing (S5).

In the shortening processing (S5), the controller 8 shortens the conveyance distance determined in the determination processing (S1) within a range of minimizing the increase in the number of the times of conveyance processing for recording the image 50 including the one-dimensional code image 100 on the paper 9, the increase being caused by execution of the shortening processing.

More specifically, the controller 8 shortens, by starting from the conveyance distance W1 shown in FIG. 5A, the conveyance distance by a distance corresponding to a particular number of dots (for example, one dot) and determines whether the defective nozzle passing region 120 overlaps a prohibition region (a region in which printing with the defective nozzle 68 should be prohibited). The prohibition region is the functional area 112 in this example (see FIG. 5B). The prohibition region is an example of a first region. In response to determining that the defective nozzle passing region 120 overlaps the prohibition region, the controller 8 further shortens the conveyance distance by the distance corresponding to the particular number of dots, and performs the determination again. This processing is repeated until determining that the defective nozzle passing region 120 does not overlap the prohibition region. In response to determining that the defective nozzle passing region 120 does not overlap the prohibition region, the controller 8 determines that the distance at that time is the conveyance distance W2. In this way, the controller 8 determines the longest conveyance distance W2 within a range that the defective nozzle passing region 120 does not overlap the prohibition region.

Figure 5C:
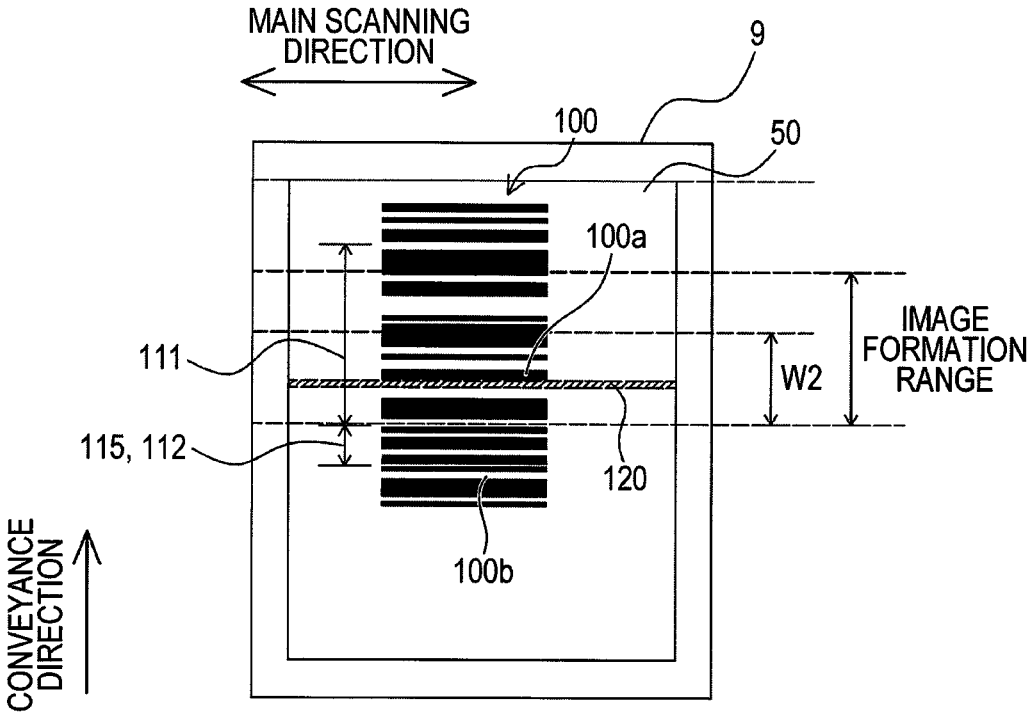

FIG. 5C shows another example in which the controller 8 performs the shortening processing (S5) such that the defective nozzle 68 originally supposed to be used for ejecting ink for forming the printed region 100*a* in the functional area 112 is located at a position corresponding to the non-printed region 100*b* in the data area 111 with respect to the conveyance direction.

In FIGS. 5B and 5C, the defective nozzle passing region 120 is located in the data area 111. Alternatively, the defective nozzle passing region 120 may be located in the non-printed region 100*b* in the functional area 112 or outside the one-dimensional code image 100. That is, the controller 8 may perform the shortening processing such that the defective nozzle 68 originally supposed to be used for ejecting ink for forming the printed region 100*a* in the functional area 112 is located at a position corresponding to any one of the data area 111, the non-printed region 100*b* in the functional area 112, or outside the one-dimensional code image 100 with respect to the conveyance direction, at the time of performing the scanning processing after the shortening processing.

Next, the controller 8 executes shortened conveyance processing (S6) of conveying the paper 9 in the conveyance direction by the conveyance distance W2 which has been shortened in the shortening processing (S5). After executing the normal conveyance processing (S3) or the shortened conveyance processing (S6), the controller 8 performs scanning processing (S7) of recording the image 50 on the paper 9 by ejecting ink from the nozzles 67 of the recording head 62 while moving the recording head 62 in the main scanning direction by the scanning mechanism 6.

Next, the controller 8 determines whether formation of the image 50 relating to image data stored in the image data storage portion 83*a* of the RAM 83 is completed (S8). In response to determining that formation of the image 50 is not completed (S8: NO), the controller 8 returns the processing to S4. In response to determining that formation of the image 50 is completed (S8: YES), the controller 8 performs discharge processing (S9) of discharging the paper 9 to the paper discharge tray 5 by the pair of discharge rollers 72. As a result, the operation of printing the image 50 on the paper 9 by the printer 10 according to the first embodiment is finished.

In the first embodiment, if the printed region 100*a* in the functional area 112 is to be formed with ink ejected from the defective nozzle 68, the shortening processing is performed such that the defective nozzle 68 is located at a position corresponding to the data area 111, the non-printed region 100*b* in the functional area 112, or outside the one-dimensional code image 100 with respect to the conveyance direction when the scanning processing is performed. Thus, the deterioration of image quality deterioration in the functional area 112 can be prevented in preference to the data area 111. This increases the degree of freedom in the shortening processing to be performed for forming lines along the main scanning direction through one scanning processing without performing a plurality of times of scanning processing. As the number of times of conveyance processing is minimized, the reduction in recording speed can be suppressed. This allows the one-dimensional code image 100 to be recorded at high speed while suppressing the occurrence of a reading error.

Second Embodiment

Next, a second embodiment of this disclosure will be described with reference to FIGS. 7A to 9. The second embodiment is directed to the image data of an image 51 in which two one-dimensional code images 101 and 102 are arranged in the main scanning direction. The one-dimensional code images 101 and 102 are located partially at the same position with respect to the conveyance direction. In the following description, the description of the same configuration as the first embodiment will be omitted.

Figure 7A:
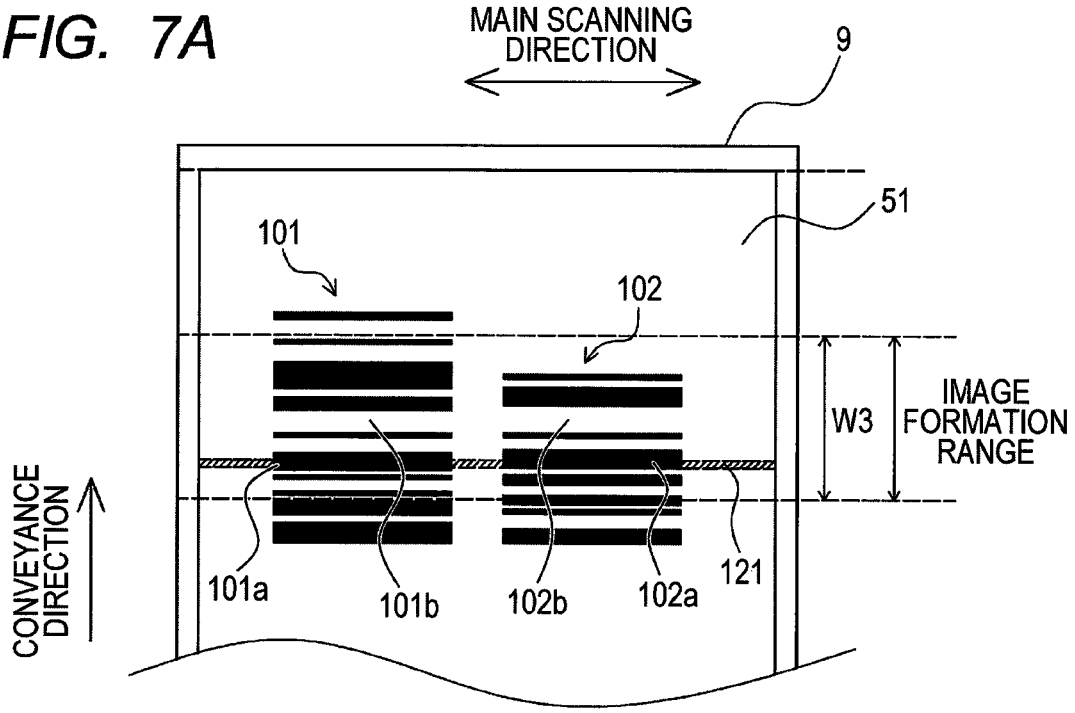
Figure 9:
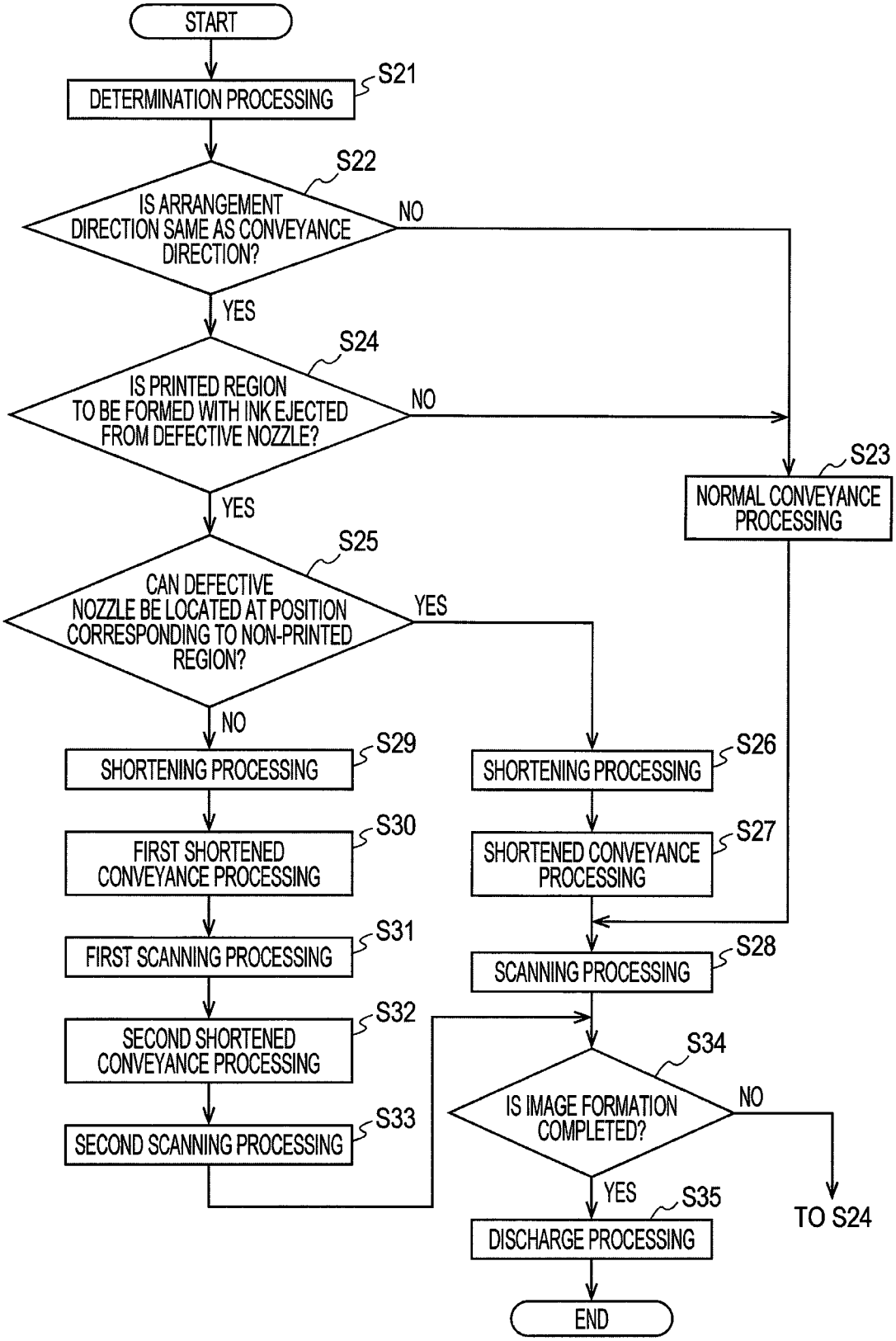
FIG. 9 is a flowchart showing the operation of an inkjet printer according to the second embodiment.

The operation of the printer 10 according to the second embodiment when recording the image 51 on paper 9 will be described below with reference to the flowchart of FIG. 9. The controller 8 performs determination processing (S21) of determining a conveyance distance W3 by which the paper 9 is to be conveyed (see FIG. 7A) in the conveyance processing performed later, based on the image data stored in the image data storage portion 83*a*. The conveyance distance W3 is an arbitrary length that is shorter than or equal to the length of an image formation range in the conveyance direction. In the example of FIG. 7A, the conveyance distance W3 has the same length as the image formation range. Next, the controller 8 performs first determination processing (S22) of determining whether the image 51 is to be recorded on the paper 9 such that the arrangement direction of each of the one-dimensional code images 101 and 102 is the same as the conveyance direction.

In response to determining that the image 51 is to be recorded on the paper 9 such that the arrangement direction of each of the one-dimensional code images 101 and 102 is not the same as the conveyance direction (S22: NO), the controller 8 performs normal conveyance processing (S23) of conveying the paper 9 in the conveyance direction by the conveyance distance W3 determined in the determination processing (S21). In response to determining that the image 51 is to be recorded on the paper 9 such that the arrangement direction of each of the one-dimensional code images 101 and 102 is the same as the conveyance direction (S22: YES), the controller 8 performs second determination processing (S24) of determining whether, if the conveyance processing is performed with the conveyance distance W3 determined in the determination processing (S21), at least one of a printed region 101*a* in the one-dimensional code image 101 and a printed region 102*a* in the one-dimensional code image 102 is formed with ink ejected from the defective nozzle 68.

In response to determining that, if the conveyance processing is performed with the conveyance distance W3, none of the printed region 101*a* in the one-dimensional code image 101 and the printed region 102*a* in the one-dimensional code image 102 is formed with ink ejected from the defective nozzle 68 (S24: NO), the controller 8 performs the normal conveyance processing (S23). In response to determining that, if the conveyance processing is performed with the conveyance distance W3, at least one of the printed region 101*a* in the one-dimensional code image 101 and the printed region 102*a* in the one-dimensional code image 102 is formed with ink ejected from the defective nozzle 68 (S24: YES), the controller 8 performs third determination processing (S25) of determining whether, by performing the conveyance processing with an arbitrary conveyance distance W4 (see FIG. 7B) shorter than the conveyance distance W3, the defective nozzle 68 can be located at a position corresponding to a non-printed region 101*b* in the one-dimensional code image 101 or outside the one-dimensional code image 101, and the position also corresponding to a non-printed region 102*b* in the one-dimensional code image 102 or outside the one-dimensional code image 102 with respect to the conveyance direction.

In response to determining that, by performing the conveyance processing with the conveyance distance W4, the defective nozzle 68 can be located at a position corresponding to the non-printed region 101*b* in the one-dimensional code image 101 or outside the one-dimensional code image 101, and the position also corresponding to the non-printed region 102*b* in the one-dimensional code image 102 or outside the one-dimensional code image 102 with respect to the conveyance direction (S25: YES), the controller 8 performs shortening processing (S26) of determining that the conveyance distance W4 (see FIG. 7B) shorter than the conveyance distance W3 is used as the conveyance distance in the conveyance processing performed before scanning processing described later.

Figure 7B:
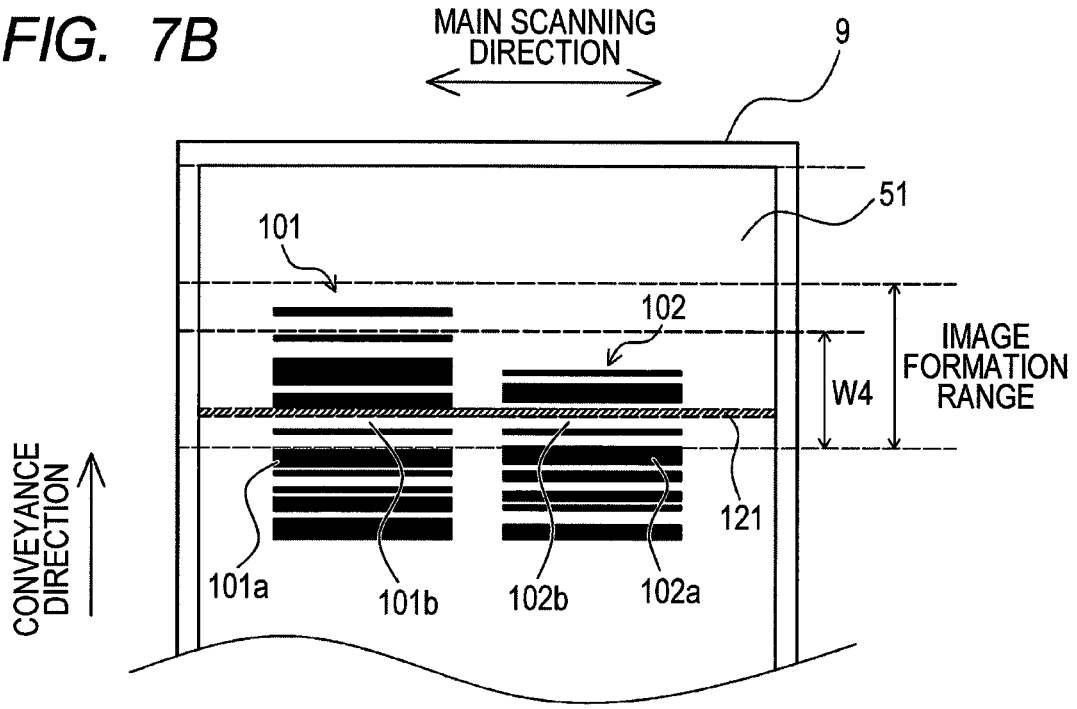

The conveyance distance W4 in the shortening processing (S26) will be described below in detail. Here, in the example of FIG. 7, the conveyance processing after an image is recorded in an image formation range by one scanning processing will be considered. As shown in FIG. 7A, there is a case where, if the paper 9 is conveyed in the conveyance direction by the length corresponding to the conveyance distance W3, a defective nozzle passing region 121 is located in the printed regions 101*a* and 102*a* in the one-dimensional code images 101 and 102 respectively (the obliquely hatched portion in FIG. 7A). In this case, the controller 8 shortens the conveyance distance to the conveyance distance W4 shorter than the conveyance distance W3 such that, as shown in FIG. 7B, the defective nozzle passing region 121 is located at a position in the non-printed region 101*b* in the one-dimensional code image 101 and also in the non-printed region 102*b* in the one-dimensional code image 102. Alternatively, the defective nozzle passing region 121 may be located at a position in the non-printed region 101*b* in the one-dimensional code image 101 and outside the one-dimensional code image 102, or may be located at a position outside the one-dimensional code image 101 and in the non-printed region 102*b* in the one-dimensional code image 102. Alternatively, the defective nozzle passing region 121 may be located at a position outside the one-dimensional code images 101 and 102.

Next, the controller 8 performs shortened conveyance processing (S27) of conveying the paper 9 in the conveyance direction by the conveyance distance W4 which is shortened in the shortening processing (S26). After performing the normal conveyance processing (S23) or the shortened conveyance processing (S27), the controller 8 performs scanning processing (S28) of recording the image 51 on the paper 9 by ejecting ink from the nozzles 67 of the recording head 62 while moving the recording head 62 in the main scanning direction by the scanning mechanism 6.

In response to determining that, by performing the conveyance processing with the conveyance distance W4, the defective nozzle 68 cannot be located at a position corresponding to the non-printed region 101*b* in the one-dimensional code image 101 or outside the one-dimensional code image 101, and the position also corresponding to the non-printed region 102*b* in the one-dimensional code image 102 or outside the one-dimensional code image 102 with respect to the conveyance direction (S25: NO), the controller 8 performs shortening processing (S29) of determining that a conveyance distance W5 shorter than the conveyance distance W3 is to be used for first shortened conveyance processing which is performed before first scanning processing described later, and determining that a conveyance distance W6 shorter than the conveyance distance W3 is to be used for second shortened conveyance processing which is performed before second scanning processing described later.

The controller 8 performs the shortening processing (S29) such that the defective nozzle 68 is located at a position corresponding to the non-printed region 101*b* in the one-dimensional code image 101 with respect to the conveyance direction when one scanning processing (first scanning processing described later) is performed after the shortening processing (S29). Also, the controller 8 performs the shortening processing (S29) such that the defective nozzle 68 is located at a position corresponding to the non-printed region 102*b* in the one-dimensional code image 102 with respect to the conveyance direction when another scanning processing (second scanning processing described later) is performed after the subsequent conveyance processing.

After the shortening processing (S29), the controller 8 performs first shortened conveyance processing (S30) of conveying the paper 9 in the conveyance direction by the conveyance distance W5. Then, the controller 8 performs first scanning processing (S31) of recording the image 51 on the paper 9 by ejecting ink from the nozzles 67 of the recording head 62 while moving the recording head 62 in the main scanning direction by the scanning mechanism 6. After the first scanning processing (S31), the controller 8 performs second shortened conveyance processing (S32) of conveying the paper 9 in the conveyance direction by the conveyance distance W6, and performs second scanning processing (S33) of recording the image 51 on the paper 9.

Figure 8A:
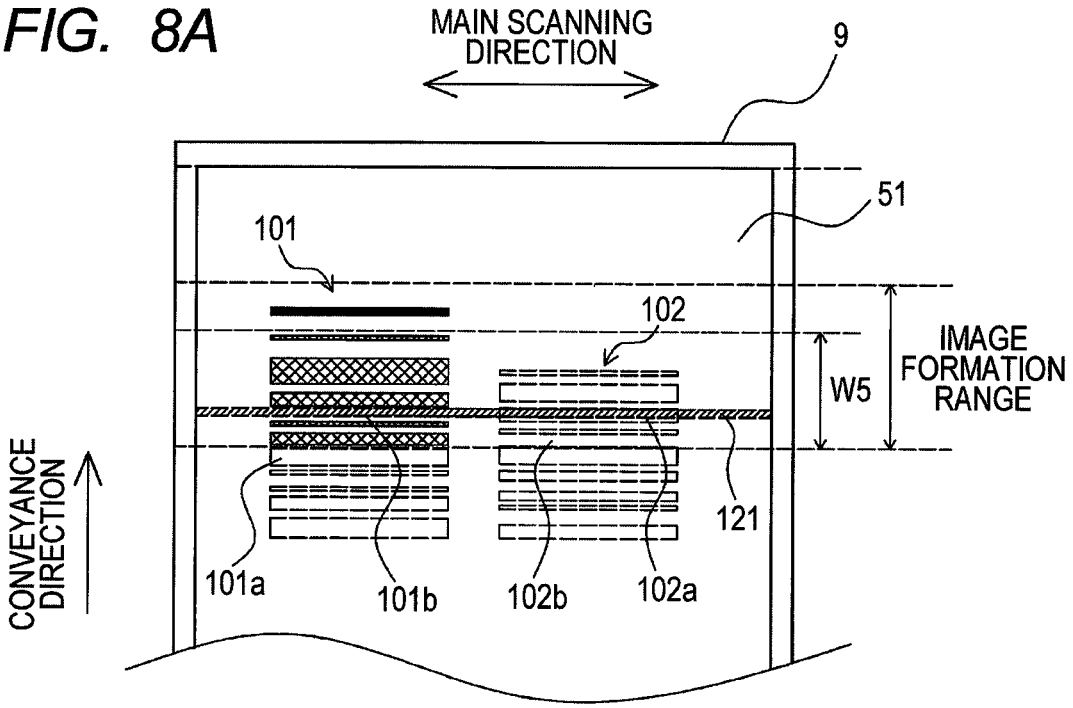
FIG. 8A is an explanatory diagram for illustrating regions that are printed by first scanning processing in the second embodiment.
Figure 8B:
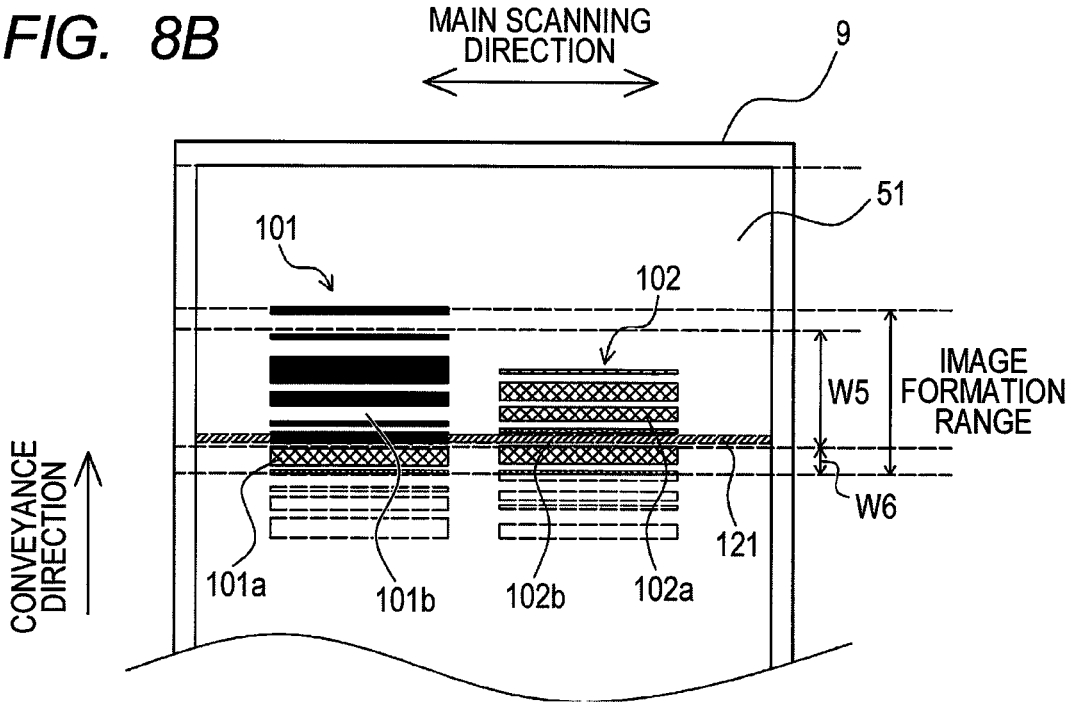
FIG. 8B is an explanatory diagram for illustrating regions that are printed by second scanning processing in the second embodiment.

The following describes the first shortened conveyance processing (S30), the first scanning processing (S31), the second shortened conveyance processing (S32), and the second scanning processing (S33) that are performed after the shortening processing (S29) described above. Here, by referring to the example of FIGS. 8A and 8B, the conveyance processing that is performed after an image is recorded in an image formation range in one scanning processing will be considered. In FIGS. 8A and 8B, the printed regions painted in black show that these regions are already printed, and the printed regions in white show that these regions are not printed yet. For example, there is a case in which, even if the paper 9 is conveyed in the conveyance direction by a length corresponding to the arbitrary conveyance distance W4 shorter than the conveyance distance W3 determined in the determination processing (S21), the defective nozzle passing region 121 cannot be located at a position in the non-printed region 101*b* in the one-dimensional code image 101 and in the non-printed region 102*b* in the one-dimensional code image 102. In this case, as shown in FIG. 8A, the controller 8 first conveys the paper 9 by the conveyance distance W5 such that the defective nozzle passing region 121 is located at a position in the non-printed region 101*b* in the one-dimensional code image 101 and in the printed region 102*a* in the one-dimensional code image 102 (first shortened conveyance processing, S30). Then, the controller 8 performs the first scanning processing (S31) of printing the printed regions 101*a* (the portions shown by oblique grids in FIG. 8A) in the one-dimensional code image 101 within the image formation range. At this time, the controller 8 does not print the printed region 102*a* in the one-dimensional code image 102. Next, as shown in FIG. 8B, the controller 8 conveys the paper 9 by the conveyance distance W6 such that the defective nozzle passing region 121 is located at a position in the printed region 101*a* in the one-dimensional code image 101 and in the non-printed region 102*b* in the one-dimensional code image 102 (second shortened conveyance processing, S32). Then, the controller 8 performs the second scanning processing (S33) of printing the unprinted ones of the printed regions 101*a* in the one-dimensional code image 101 and printing the printed regions 102*a* in the one-dimensional code image 102 (the portions shown by oblique grids in FIG. 8B) within the new image formation range. In this way, even in a case where the defective nozzle passing region 121 cannot be located at a position in the non-printed region 101*b* in the one-dimensional code image 101 and in the non-printed region 102*b* in the one-dimensional code image 102, printing is performed in a state where the defective nozzle passing region 121 is not located in a printed region in the one-dimensional code images 101 and 102. This prevents deterioration of image quality in the two one-dimensional code images 101 and 102 that are located partially at the same position with respect to the conveyance direction.

After executing the scanning processing (S28) or the second scanning processing (S33), the controller 8 determines whether formation of the image 51 relating to the image data stored in the image data storage portion 83*a* of the RAM 83 is completed (S34). In response to determining that formation of the image 51 is not completed (S34: NO), the controller 8 returns the processing to S24. In response to determining that formation of the image 51 is completed (S34: YES), the controller 8 performs discharge processing (S35) of discharging the paper 9 to the paper discharge tray 5 by using the pair of discharge rollers 72. In this way, the operation of printing the image 51 on the paper 9 by the printer 10 according to the second embodiment is finished.

According to the second embodiment, even in a case where the two one-dimensional code images 101 and 102 are arranged side by side, the defective nozzle 68 is located at a position corresponding to the non-printed region 101*b* and the non-printed region 102*b* with respect to the conveyance direction, thereby preventing deterioration of image quality in the one-dimensional code images 101 and 102. Further, in a case where the defective nozzle 68 cannot be located at a position corresponding to the non-printed region 101*b* and the non-printed region 102*b* with respect to the conveyance direction, scanning processing is first performed in a state where the defective nozzle 68 is located at a position corresponding to the non-printed region 101*b* with respect to the conveyance direction, and then scanning processing is performed again in a state where the defective nozzle 68 is located at a position corresponding to the non-printed region 102*b* with respect to the conveyance direction. Thus, deterioration of image quality in the one-dimensional code images 101 and 102 can be prevented.

Third Embodiment

Next, a third embodiment of this disclosure will be described with reference to FIG. 10. Although the first embodiment and the second embodiment are directed to image data relating to an image including a one-dimensional code image, the present embodiment is directed to image data relating to an image including a two-dimensional code image 200. In the following description, the description of the same configuration as the first embodiment will be omitted.

Figure 10:
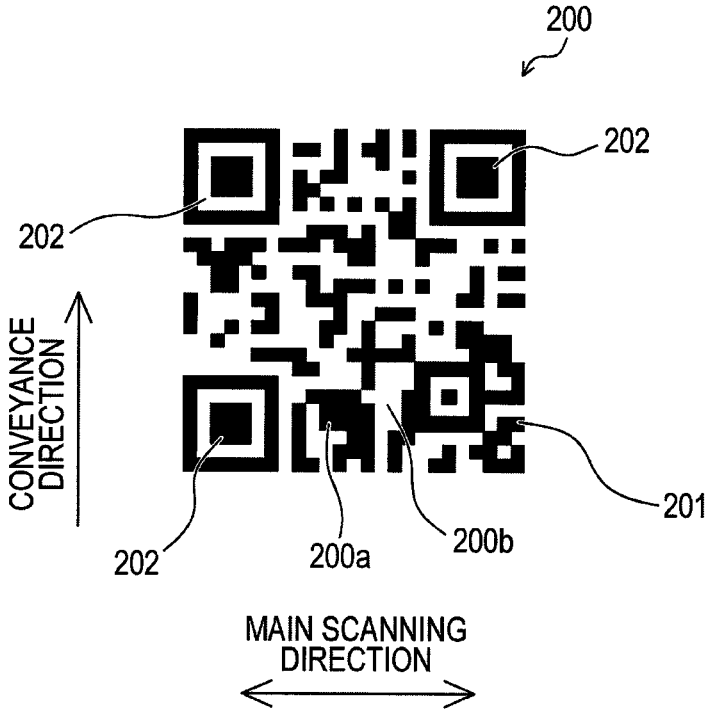
FIG. 10 is an explanatory diagram for illustrating a two-dimensional code image according to a third embodiment.

The two-dimensional code image 200 shown in FIG. 10 is a QR code™. As shown in FIG. 10, the two-dimensional code image 200 includes a plurality of square printed regions 200*a* arranged in a mosaic pattern in a square region 201 with sides extending in the upper-lower direction and sides extending in the left-right direction. More specifically, in the square region 201 of the two-dimensional code image 200, the printed regions 200*a* and non-printed regions 200*b* are formed alternately, both in the upper-lower direction and in the left-right direction. The two-dimensional code image 200 is divided into a data area in which data to be read is displayed, and a functional area other than the data area (both of these areas are not shown in the drawing). For example, the functional area includes finder patterns 202 formed at three corners of the square region 201 (in FIG. 10, the upper right corner, the upper left corner, and the lower left corner) and used for detecting the position of the two-dimensional code image 200 in the upper-lower direction and in the left-right direction.

Figure 6:
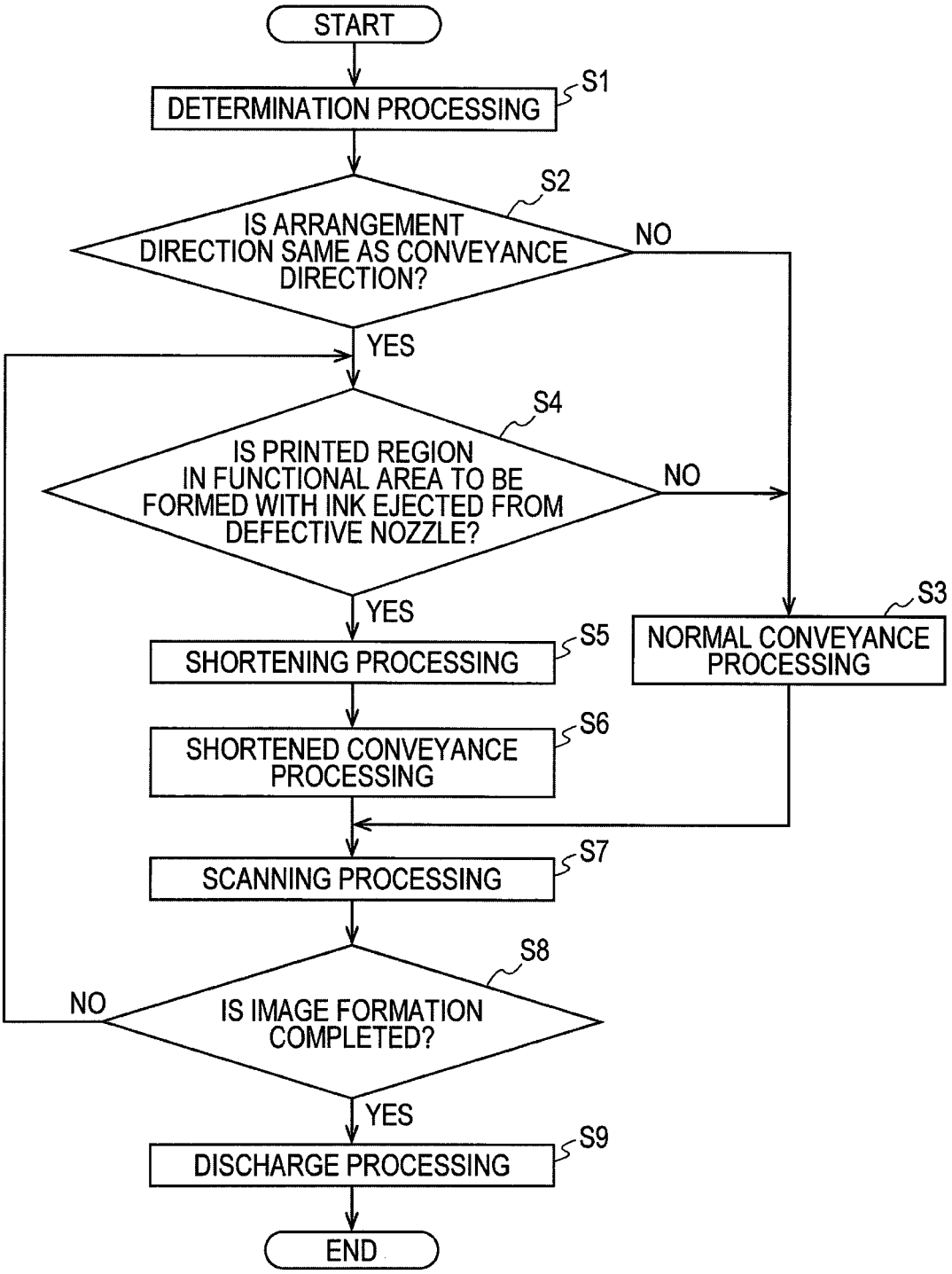
FIG. 6 is a flowchart showing the operation of the inkjet printer according to the first embodiment.

In the first determination processing of the first embodiment, the controller 8 determines whether the image 50 including the one-dimensional code image 100 is to be recorded on the paper 9 such that the arrangement direction of the one-dimensional code image 100 is the same as the conveyance direction (S2 in FIG. 6). In the first determination processing of the present embodiment, the controller 8 simply determines whether an image including the two-dimensional code image 200 having the data area and the functional area is to be recorded on the paper 9.

In the present embodiment, the controller 8 performs shortening processing such that, if the defective nozzle 68 is to form the functional area such as the finder pattern 202, the defective nozzle 68 is located at a position not corresponding to the functional area with respect to the conveyance direction when scanning processing is performed after that shortening processing.

In the present embodiment, if the printed region in the functional area (for example, the printed region of the finder pattern 202) is to be formed with ink ejected from the defective nozzle 68, the shortening processing is performed such that the defective nozzle 68 is located at a position corresponding to the data area or outside the two-dimensional code image 200 with respect to the conveyance direction when the scanning processing is performed. Thus, the deterioration of image quality deterioration in the functional area can be prevented in preference to the data area. This increases the degree of freedom in the shortening processing to be performed for forming lines along the main scanning direction through one scanning processing without performing a plurality of times of scanning processing. This allows the two-dimensional code image 200 to be recorded at high speed while suppressing the occurrence of a reading error.

Fourth Embodiment

Figure 11:
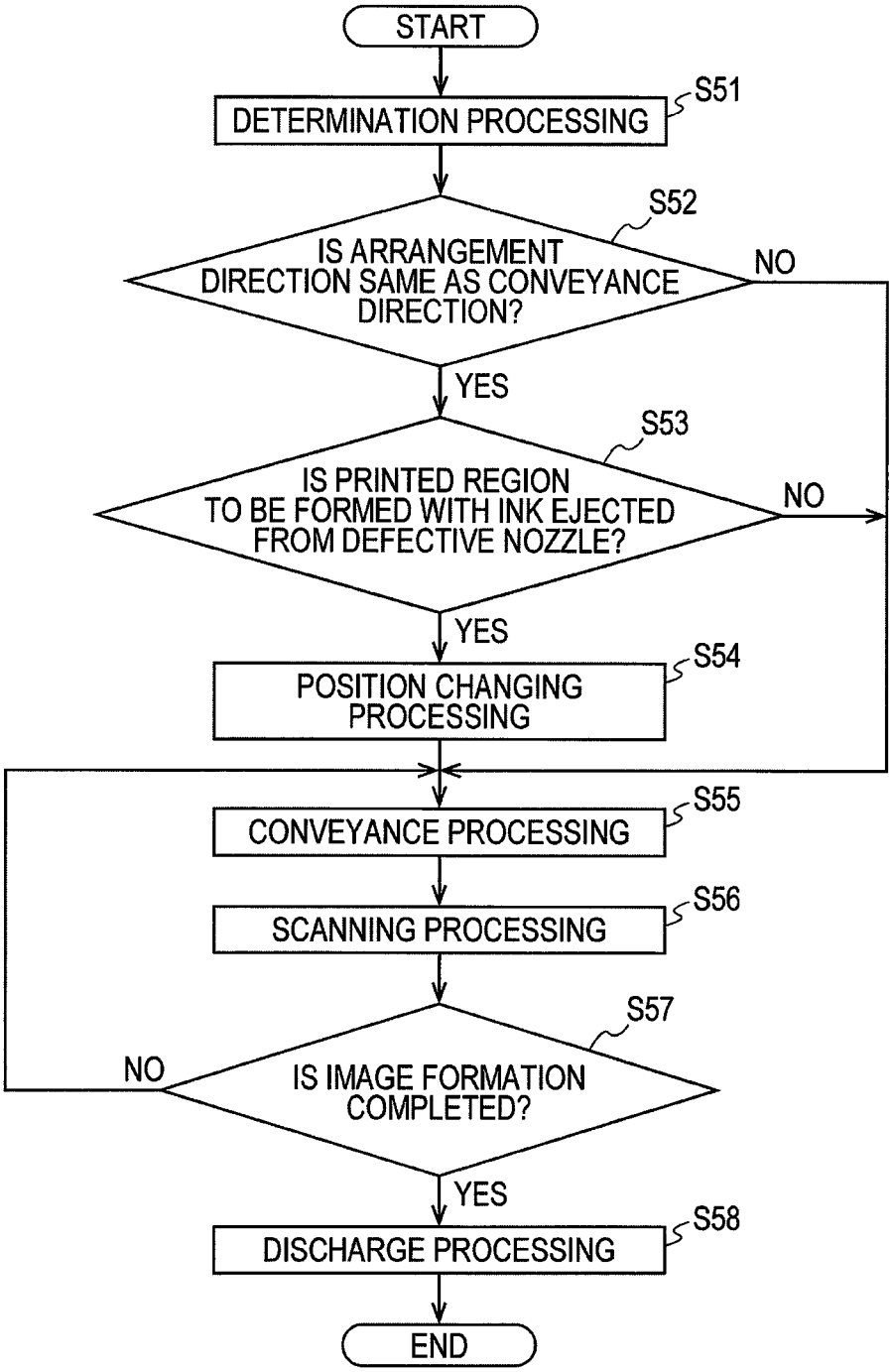
FIG. 11 is a flowchart showing the operation of an inkjet printer according to a fourth embodiment.

A fourth embodiment will be described. In the first or third embodiment, the shortening processing is performed such that the defective nozzle 68 is located at a position corresponding to the data area (either the printed region or the non-printed region), the non-printed region in the functional area, or outside the code image with respect to the conveyance direction, thereby preventing deterioration of image quality in the one-dimensional code image 100 or the two-dimensional code image 200. In the second embodiment, in a case where the two one-dimensional code images 101 and 102 are arranged side by side, the defective nozzle 68 is sequentially located at a position corresponding to the non-printed region 101*b* and the non-printed region 102*b* with respect to the conveyance direction, thereby preventing deterioration of image quality in the one-dimensional code images 101 and 102. In each of the first to third embodiments, deterioration of image quality in the code images is prevented by performing the shortening processing of shortening the conveyance distance in the conveyance processing. In the fourth embodiment, if it is determined that a printed region in the code image is to be formed with ink ejected from the defective nozzle 68, the controller 8 performs position changing processing of changing the position in the conveyance direction of the code image in image data stored in the image data storage portion 83*a*, instead of performing the shortening processing. The operation of a printer 10 according to the fourth embodiment will be described below by referring to the flowchart in FIG. 11. The fourth embodiment is directed to image data relating to an image 50 including a one-dimensional code image 100 formed with a plurality of printed regions 100*a* and a plurality of non-printed regions 100*b* (see FIG. 4). In the following description, the description of the same configuration as the first embodiment will be omitted.

First, the controller 8 performs determination processing (S51) of determining the distance by which the paper 9 is to be conveyed in conveyance processing performed later based on the image data stored in the image data storage portion 83*a*. Next, the controller 8 performs first determination processing (S52) of determining whether the image 50 including the one-dimensional code image 100 is to be recorded on the paper 9 such that the arrangement direction of the one-dimensional code image 100 is the same as the conveyance direction.

In response to determining that the image 50 is to be recorded on the paper 9 such that the arrangement direction of the one-dimensional code image 100 is the same as the conveyance direction (S52: YES), the controller 8 performs second determination processing (S53) of determining whether, if conveyance processing is performed with the conveyance distance determined in the determination processing (S51), one of the printed regions 100*a* is to be formed with ink ejected from the defective nozzle 68.

In response to determining that, if conveyance processing is performed with the conveyance distance determined in the determination processing (S51), one of the printed regions 100*a* is to be formed with ink ejected from the defective nozzle 68 (S53: YES), the controller 8 performs position changing processing (S54) of changing the position in the conveyance direction of the one-dimensional code image 100 in the image data stored in the image data storage portion 83*a*. The position changing processing is performed such that the defective nozzle 68 originally supposed to eject ink for forming the printed region 100*a* is located at a position corresponding to the non-printed region 100*b* of the one-dimensional code image 100 or outside the one-dimensional code image 100 with respect to the conveyance direction when scanning processing is performed after the position changing processing. More specifically, the controller 8 repeats shifting the position of the one-dimensional code image 100 in the image data in the conveyance direction by a particular number of dots (for example, one dot). Then, when the defective nozzle 68 is located at a position corresponding to the non-printed region 100*b* of the one-dimensional code image 100 or outside the one-dimensional code image 100 with respect to the conveyance direction, the controller 8 determines that the image data at that time is the image data to be recorded on the paper 9.

In a case where the length of the one-dimensional code image 100 in the conveyance direction is greater than the length of the image formation range in the conveyance direction in one scanning processing, a plurality of times of conveyance processing and scanning processing need to be performed. In this case, the controller 8 performs the position changing processing such that the defective nozzle 68 is located at a position corresponding to the non-printed region 100*b* of the one-dimensional code image 100 or outside the one-dimensional code image 100 with respect to the conveyance direction when the plurality of times of scanning processing is performed after the position changing processing.

In response to determining that the image 50 is to be recorded on the paper 9 such that the arrangement direction of the one-dimensional code image 100 is not the same as the conveyance direction (S52: NO), or in response to determining that, if conveyance processing is performed with the conveyance distance determined in the determination processing (S51), none of the printed regions 100*a* is to be formed with ink ejected from the defective nozzle 68 (S53: NO), the controller 8 performs conveyance processing (S55) of conveying the paper 9 in the conveyance direction by the conveyance distance determined in the determination processing (S51). The controller 8 also performs the conveyance processing (S55) of conveying the paper 9 in the conveyance direction by the conveyance distance determined in the determination processing (S51) after executing the position changing processing (S54).

Next, the controller 8 performs scanning processing (S56) of recording the image 50 on the paper 9 by ejecting ink from the nozzles 67 of the recording head 62 while moving the recording head 62 in the main scanning direction by using the scanning mechanism 6. After executing the scanning processing (S56), the controller 8 determines whether formation of the image 50 relating to the image data stored in the image data storage portion 83*a* is completed (S57). In response to determining that formation of the image 50 is not completed (S57: NO), the controller 8 returns the processing to S55. In response to determining that formation of the image 50 is completed (S57: YES), the controller 8 performs discharge processing (S58) of discharging the paper 9 to the paper discharge tray 5 by using the pair of discharge rollers 72. In this way, the operation of printing the image 50 on the paper 9 by the printer 10 according to the fourth embodiment is finished.

According to the fourth embodiment, even in a case where there is a defective nozzle 68 which causes ejection failure (no ejection) or deviation of ejection direction, the position of the code image in image data is changed such that the printed region in the code image is not formed with ink ejected from the defective nozzle 68. This prevents the occurrence of a white streak or a black streak, thereby preventing deterioration of image quality in the one-dimensional code image 100.

Modification

While the disclosure has been described in detail with reference to the above aspects thereof, it would be apparent to those skilled in the art that various changes and modifications may be made therein without departing from the scope of the claims.

In the above-described embodiments, the conveyance processing is performed once before executing the scanning processing of forming the printed regions in the code image. In the shortening processing, a conveyance distance in one conveyance processing is shortened. Alternatively, a plurality of times of conveyance processing may be performed before executing the scanning processing of forming the printed regions 100*a* in the code image. In this case, in the shortening processing, the controller 8 may shorten a conveyance distance in one of the plurality of times of conveyance processing or may shorten conveyance distances in two or more of the plurality of times of conveyance processing.

In the first embodiment, the controller 8 performs the second determination processing (S4) of determining whether, if the conveyance processing is performed by using the conveyance distance W1, any one of the printed regions 100*a* in the functional area 112 is formed with ink ejected from the defective nozzle 68. Alternatively, the controller 8 may perform the second determination processing of determining whether, if the conveyance processing is performed by using the conveyance distance W1, any one of the printed regions 100*a* in the one-dimensional code image 100 (that is, not limited to the functional area 112) is formed with ink ejected from the defective nozzle 68. In response to determining that, if the conveyance processing is performed by using the conveyance distance W1, any one of the printed regions 100*a* in the one-dimensional code image 100 is formed with ink ejected from the defective nozzle 68, the controller 8 performs the shortening processing of changing the conveyance distance from the conveyance distance W1 to the conveyance distance W2 shorter than W1 such that the defective nozzle 68 originally supposed to eject ink for forming the printed region 100*a* is located at a position corresponding to any one of the non-printed regions 100*b* in the one-dimensional code image 100 or outside the one-dimensional code image 100. With this operation, deterioration of image quality in the one-dimensional code image 100 is prevented more reliably. On the other hand, comparing with the first embodiment in which it is determined whether it will be formed with ink ejected from the defective nozzle 68 for only the printed region 100*a* in the functional area 112, there is a higher probability that the shortening processing and the shortened conveyance processing are performed. Thus, the recording speed of forming the entire image 50 including the one-dimensional code image 100 is likely to be reduced. Accordingly, depending on which one of the image quality of the one-dimensional code image 100 and the recording speed of the entire image 50 is given a higher priority, it is preferable to determine whether the printed region 100*a* in the entire one-dimensional code image 100 or the printed region 100*a* only in the functional area 112 is formed with ink ejected from the defective nozzle 68.

While the above-described embodiments have been described on the assumption that there is one defective nozzle 68, there may be a plurality of defective nozzles 68. In this case, the controller 8 performs the second determination processing of determining whether, if the conveyance processing is performed by using the conveyance distance determined in the determination processing, any printed region is formed with ink ejected from the plurality of defective nozzles 68.

In the second embodiment, the controller 8 may perform the third determination processing (S25) of determining whether, if the conveyance processing is performed by using the arbitrary conveyance distance W4 (see FIG. 7B) shorter than the conveyance distance W3, the defective nozzle 68 can be located at a position (in this paragraph, referred to as "such position") corresponding to the data area in the one-dimensional code image 101, the non-printed region 101*b* in the functional area in the one-dimensional code image 101, or outside the one-dimensional code image 101, the position also corresponding to the data area in the one-dimensional code image 102, the non-printed region 102*b* in the functional area in the one-dimensional code image 102, or outside the one-dimensional code image 102 with respect to the conveyance direction. In response to determining that, if the conveyance processing is performed by using the conveyance distance W4, the defective nozzle 68 can be located at such position with respect to the conveyance direction (S25: YES), the controller 8 performs the shortening processing (S26) of determining that the conveyance distance is W4. In this modification, a case in which the first shortened conveyance processing, the first scanning processing, the second shortened conveyance processing, and the second scanning processing are performed can be avoided more easily since this case takes a relatively long time. Further, deterioration of image quality in the functional area can be prevented in preference to the data area, and thus image recording at high-speed and prevention of image quality deterioration can be more likely realized simultaneously.

In the fourth embodiment, the controller 8 may perform the second determination processing (S53) of determining whether, if the conveyance processing is performed by using the conveyance distance determined in the determination processing, one of the printed regions 100*a* in the functional area 112 is to be formed with ink ejected from the defective nozzle 68. In response to determining that, if the conveyance processing is performed by using the determined conveyance distance, one of the printed regions 100*a* in the functional area 112 is to be formed with ink ejected from the defective nozzle 68 (S53: YES), the controller 8 performs the position changing processing (S54) of changing the position in the conveyance direction of the one-dimensional code image 100 in the image data. The controller 8 performs the position changing processing such that the defective nozzle 68 is located at a position corresponding to the data area 111, the non-printed region 100*b* in the functional area 112, or outside the one-dimensional code image 100 with respect to the conveyance direction when the scanning processing is performed after the position changing processing.

In the second embodiment, the target image data may be image data for an image including three or more one-dimensional code images that are located partially at the same position with respect to the conveyance direction and arranged side by side in the main scanning direction. In this case, the controller 8 performs the third determination processing (S25) of determining whether, if the conveyance processing is performed by using the arbitrary conveyance distance W4 (see FIG. 7B), the defective nozzle 68 can be located at a position corresponding to non-printed regions of the three or more one-dimensional code images or outside the one-dimensional code images.

In the third embodiment, the target image data may be image data for an image including two or more two-dimensional code images that are located partially at the same position with respect to the conveyance direction and arranged side by side in the main scanning direction. In this case, the printer 10 performs operations similar to those described in the second embodiment. In the first determination processing, however, the controller 8 determines whether the two or more two-dimensional code images located partially at the same position with respect to the conveyance direction are to be recorded on the paper 9.

In the first embodiment, the controller 8 performs the shortening processing of shortening the conveyance distance determined in the determination processing within a range of minimizing the increase in the number of times of conveyance processing for recording the image 50 including the one-dimensional code image 100 on the paper 9, the increase in the number of times of conveyance processing being caused by execution of the shortening processing. Alternatively, the controller 8 may shorten the conveyance distance determined in the determination processing beyond the range of minimizing the increase in the number of times of conveyance processing. That is, it is not necessarily required to minimize the increase in the number of times of conveyance processing in the shortening processing. From the viewpoint of suppressing deterioration in recording speed, however, it is preferable that the conveyance distance determined in the determination processing be shortened within the range of minimizing the increase in the number of times of conveyance processing. Further, in the second to fourth embodiments, the controller 8 may shorten the conveyance distance determined in the determination processing beyond the range of minimizing the increase in the number of times of conveyance processing.

In the above-described first to fourth embodiments, the controller 8 provided in the printer 10 executes the determination processing, the first and second determination processing, the shortening processing, the shortened conveyance processing, the scanning processing, the position changing processing, and so on. The present disclosure is not limited to this. For example, the printer driver installed in the HDD of the PC 20 connected to the printer 10 or in the ROM of the mobile terminal may cause the PC 20 or the mobile terminal to execute some or all of these processing.

What is claimed is:

1. An image forming apparatus comprising:

a head having a plurality of ejection ports configured to eject liquid;

a conveyor configured to convey a recording medium in a conveyance direction;

a carriage on which the head is mounted, the carriage being configured to reciprocate in a main scanning direction perpendicular to the conveyance direction;

a memory configured to store identification information of a defective ejection port among the plurality of ejection ports and to store image data for an image to be recorded on a recording medium; and a controller configured to:

determine an original conveyance distance based on image data stored in the memory;

determine, based on the image data, whether a particular code image is to be recorded on the recording medium, the particular code image being formed with a plurality of printed regions and a plurality of non-printed regions, the particular code image including a first region and a second region, the first region being a region prohibited from being formed with the defective ejection port, the second region being a region other than the first region;

in response to determining that the particular code image is to be recorded on the recording medium, determine, based on the image data and on the identification information of the defective ejection port, whether the first region is to be formed with liquid ejected from the defective ejection port assuming that the recording medium is conveyed by the original conveyance distance in conveyance processing;

in response to determining that the first region is to be formed with liquid ejected from the defective ejection port, determine a shortened conveyance distance shorter than the original conveyance distance, the shortened conveyance distance being determined such that the defective ejection port is located at a position corresponding to the second region with respect to the conveyance direction;

perform shortened conveyance processing of controlling the conveyor to convey the recording medium in the conveyance direction by the shortened conveyance distance; and after performing the shortened conveyance processing, control the carriage to cause the head to move in the main scanning direction and control the head to record the image on the recording medium.

2. The image forming apparatus according to claim 1, wherein the determining whether the particular code image is to be recorded on the recording medium includes determining whether a one-dimensional code image is to be recorded on the recording medium in an orientation that a direction in which the plurality of printed regions and the plurality of non-printed regions are arranged alternately is same as the conveyance direction.

3. The image forming apparatus according to claim 1, wherein the determining whether the particular code image is to be recorded on the recording medium includes determining whether a two-dimensional code image including the plurality of printed regions and the plurality of non-printed regions is to be recorded on the recording medium, the two-dimensional code image including a data area and a functional area, the data area being an area for displaying data to be read, the functional area being an area other than the data area.

4. The image forming apparatus according to claim 1, wherein the determining the shortened conveyance distance includes determining the shortened conveyance distance so as to minimize an increase in a number of times of the conveyance processing for recording the particular code image on the recording medium, the increase in the number of times of the conveyance processing being caused by shortening the original conveyance distance.

5. The image forming apparatus according to claim 4, wherein the determining the shortened conveyance distance includes:

reducing, by starting from the original conveyance distance, a conveyance distance by a distance corresponding to a particular number of dots and determining whether the first region is to be formed with liquid ejected from the defective ejection port assuming that the conveyance processing is performed with the reduced conveyance distance;

in response to determining that the first region is to be formed with liquid ejected from the defective ejection port, further reducing the conveyance distance by the distance corresponding to the particular number of dots; and in response to determining that the first region is not to be formed with liquid ejected from the defective ejection port, determining that the conveyance distance at that time is the shortened conveyance distance used for the shortened conveyance processing.

6. The image forming apparatus according to claim 1, wherein the controller is configured to:

in a case where a first code image and a second code image are arranged in the main scanning direction such that the first code image and the second code image are located at least partially at a same position with respect to the conveyance direction, determine whether the defective ejection port can be located at a particular position other than the first region of the first code image and other than the first region of the second code image with respect to the conveyance direction;

in response to determining that the defective ejection port can be located at the particular position, determine the shortened conveyance distance such that the defective ejection port is located at the particular position; and in response to determining that the defective ejection port cannot be located at the particular position, perform first shortened conveyance processing such that the defective ejection port is located at a position corresponding to the second region of the first code image with respect to the conveyance direction;

after performing the first shortened conveyance processing, perform first scanning processing of controlling the carriage and the head to record the first code image on the recording medium;

after performing the first scanning processing, perform second shortened conveyance processing such that the defective ejection port is located at a position corresponding to the second region of the second code image with respect to the conveyance direction; and after performing the second shortened conveyance processing, perform second scanning processing of controlling the carriage and the head to record the second code image on the recording medium.

7. The image forming apparatus according to claim 1, wherein the first region includes the plurality of printed regions in the particular code image; and wherein the second region includes the plurality of non-printed regions and a region outside the particular code image.

8. The image forming apparatus according to claim 1, wherein the particular code image includes a data area and a functional area, the data area being an area for displaying data to be read, the functional area being an area other than the data area;

wherein the first region includes the functional area; and wherein the second region includes the data area and a region outside the particular code image.

9. The image forming apparatus according to claim 1, wherein the particular code image includes a data area and a functional area, the data area being an area for displaying data to be read, the functional area being an area other than the data area;

wherein the first region includes a printed region in the functional area; and wherein the second region includes the data area, a non-printed region in the functional area, and a region outside the particular code image.

10. The image forming apparatus according to claim 1, wherein the original conveyance distance is equal to a unit conveyance length that is a length of an image formation range in the conveyance direction, the image formation range being a range in which an image can be formed by ejecting ink from the plurality of ejection ports of the head.

11. An image forming apparatus comprising:

a head having a plurality of ejection ports configured to eject liquid;

a conveyor configured to convey a recording medium in a conveyance direction;

a carriage on which the head is mounted, the carriage being configured to reciprocate in a main scanning direction perpendicular to the conveyance direction;

a memory configured to store identification information of a defective ejection port among the plurality of ejection ports and to store image data for an image to be recorded on a recording medium; and a controller configured to:

determine a conveyance distance based on image data stored in the memory;

determine, based on the image data, whether a particular code image is to be recorded on the recording medium, the particular code image being formed with a plurality of printed regions and a plurality of non-printed regions, the particular code image including a first region and a second region, the first region being a region prohibited from being formed with the defective ejection port, the second region being a region other than the first region;

in response to determining that the particular code image is to be recorded on the recording medium, determine, based on the image data and on the identification information of the defective ejection port, whether the first region is to be formed with liquid ejected from the defective ejection port assuming that the recording medium is conveyed by the original conveyance distance in conveyance processing;

in response to determining that the first region is to be formed with liquid ejected from the defective ejection port, change a position of the particular code image in the conveyance direction in the image data stored in the memory, the position of the particular code image in the image data being changed such that the defective ejection port is located at a position corresponding to the second region with respect to the conveyance direction;

perform conveyance processing of controlling the conveyor to convey the recording medium in the conveyance direction by the determined conveyance distance; and after performing the conveyance processing, control the carriage to cause the head to move in the main scanning direction and control the head to record the image on the recording medium.

12. A non-transitory computer-readable storage medium storing a set of program instructions for a computer of an electronic device that controls an image forming apparatus, the set of program instructions, when executed by the computer, causing the electronic device to:

determine a conveyance distance of a recording medium based on image data stored in a memory of the image forming apparatus, the image forming apparatus including a head having a plurality of ejection ports configured to eject liquid, a conveyor configured to convey a recording medium in a conveyance direction, a carriage on which the head is mounted and configured to reciprocate in a main scanning direction perpendicular to the conveyance direction, the image forming apparatus being configured to perform conveyance processing of controlling the conveyor to convey a recording medium in the conveyance direction and scanning processing of controlling the carriage to cause the head to move in the main scanning direction and controlling the head to record an image on the recording medium, the memory storing identification information of a defective ejection port among the plurality of ejection ports;

determine whether a particular code image is to be recorded on the recording medium, the particular code image being formed with a plurality of printed regions and a plurality of non-printed regions, the particular code image including a first region and a second region, the first region being a region prohibited from being formed with the defective ejection port, the second region being a region other than the first region;

in response to determining that the particular code image is to be recorded on the recording medium, determine, based on the image data and on the identification information of the defective ejection port, whether the first region is to be formed with liquid ejected from the defective ejection port assuming that the conveyance processing is performed with the original conveyance distance; and in response to determining that the first region is to be formed with liquid ejected from the defective ejection port, perform either one of:

shortening the conveyance distance in at least one of one or a plurality of times of the conveyance processing that is performed before the scanning processing in which the first region is formed, the conveyance distance being shortened such that the defective ejection port is located at a position corresponding to the second region with respect to the conveyance direction when the scanning processing is performed after shortening the conveyance distance; and changing a position of the particular code image in the conveyance direction in the image data such that the defective ejection port is located at a position corresponding to the second region with respect to the conveyance direction when the scanning processing is performed after changing the position of the particular code image in the image data.

13. The non-transitory computer-readable storage medium according to claim 12, wherein the determining whether the particular code image is to be recorded on the recording medium includes determining whether a one-dimensional code image is to be recorded on the recording medium in an orientation that a direction in which the plurality of printed regions and the plurality of non-printed regions are arranged alternately is same as the conveyance direction.

14. The non-transitory computer-readable storage medium according to claim 12, wherein the determining whether the particular code image is to be recorded on the recording medium includes determining whether a two-dimensional code image including the plurality of printed regions and the plurality of non-printed regions is to be recorded on the recording medium, the two-dimensional code image including a data area and a functional area, the data area being an area for displaying data to be read, the functional area being an area other than the data area.

15. The non-transitory computer-readable storage medium according to claim 12, wherein the shortening the conveyance distance includes shortening the conveyance distance so as to minimize an increase in a number of times of the conveyance processing for recording the particular code image on the recording medium, the increase in the number of times of the conveyance processing being caused by shortening the original conveyance distance.

16. The non-transitory computer-readable storage medium according to claim 15, wherein the shortening the conveyance distance includes:

reducing, by starting from the original conveyance distance, a conveyance distance by a distance corresponding to a particular number of dots and determining whether the first region is to be formed with liquid ejected from the defective ejection port assuming that the conveyance processing is performed with the reduced conveyance distance;

in response to determining that the first region is to be formed with liquid ejected from the defective ejection port, further reducing the conveyance distance by the distance corresponding to the particular number of dots; and in response to determining that the first region is not to be formed with liquid ejected from the defective ejection port, determining that the conveyance distance at that time is the conveyance distance used for shortened conveyance processing.

17. The non-transitory computer-readable storage medium according to claim 12, wherein the set of program instructions, when executed by the computer, causes the electronic device to:

in a case where a first code image and a second code image are arranged in the main scanning direction such that the first code image and the second code image are located at least partially at a same position with respect to the conveyance direction, determine whether the defective ejection port can be located at a particular position other than the first region of the first code image and other than the first region of the second code image with respect to the conveyance direction;

in response to determining that the defective ejection port can be located at the particular position, shorten the conveyance distance such that the defective ejection port is located at the particular position; and in response to determining that the defective ejection port cannot be located at the particular position, perform first shortened conveyance processing such that the defective ejection port is located at a position corresponding to the second region of the first code image with respect to the conveyance direction;

after performing the first shortened conveyance processing, perform first scanning processing of controlling the carriage and the head to record the first code image on the recording medium;

after performing the first scanning processing, perform second shortened conveyance processing such that the defective ejection port is located at a position corresponding to the second region of the second code image with respect to the conveyance direction; and after performing the second shortened conveyance processing, perform second scanning processing of controlling the carriage and the head to record the second code image on the recording medium.

18. The non-transitory computer-readable storage medium according to claim 12, wherein the first region includes the plurality of printed regions in the particular code image; and wherein the second region includes the plurality of non-printed regions and a region outside the particular code image.

19. The non-transitory computer-readable storage medium according to claim 12, wherein the particular code image includes a data area and a functional area, the data area being an area for displaying data to be read, the functional area being an area other than the data area;

wherein the first region includes the functional area; and wherein the second region includes the data area and a region outside the particular code image.

20. The non-transitory computer-readable storage medium according to claim 12, wherein the particular code image includes a data area and a functional area, the data area being an area for displaying data to be read, the functional area being an area other than the data area;

wherein the first region includes a printed region in the functional area; and wherein the second region includes the data area, a non-printed region in the functional area, and a region outside the particular code image.

* * * * *